US010352163B2

(12) United States Patent
Hagenbuch

(10) Patent No.: US 10,352,163 B2
(45) **Date of Patent: *Jul. 16, 2019**

(54) CUTTER ASSEMBLY WITH FREEWHEELING CUTTING ELEMENTS

(71) Applicant: LeRoy G. Hagenbuch, Peoria Heights, IL (US)

(72) Inventor: LeRoy G. Hagenbuch, Peoria Heights, IL (US)

( * ) Notice: Subject to any disclaimer, the term of this patent is extended or adjusted under 35 U.S.C. 154(b) by 163 days.

This patent is subject to a terminal disclaimer.

(21) Appl. No.: 15/278,628

(22) Filed: Sep. 28, 2016

(65) Prior Publication Data

US 2017/0016322 A1 Jan. 19, 2017

Related U.S. Application Data

(63) Continuation-in-part of application No. 14/611,161, filed on Jan. 30, 2015, now Pat. No. 9,828,742.

(60) Provisional application No. 62/010,171, filed on Jun. 10, 2014, provisional application No. 61/947,749, filed on Mar. 4, 2014, provisional application No. 61/934,476, filed on Jan. 31, 2014.

(51) Int. Cl.

| | |
|---|---|
| ***E21C 25/40*** | (2006.01) |
| ***E02F 3/08*** | (2006.01) |
| ***E02F 3/10*** | (2006.01) |
| ***E02F 3/14*** | (2006.01) |
| ***E02F 5/06*** | (2006.01) |
| ***E02F 9/28*** | (2006.01) |
| ***E21C 25/00*** | (2006.01) |

(52) U.S. Cl.

CPC ..... *E21C 25/40* (2013.01); *E02F 3/086* (2013.01); *E02F 3/088* (2013.01); *E02F 3/10* (2013.01); *E02F 3/142* (2013.01); *E02F 5/06* (2013.01); *E02F 9/2858* (2013.01); *E02F 9/2866* (2013.01); *E21C 25/00* (2013.01)

(58) Field of Classification Search

CPC ..... E21C 25/40; E21C 25/00; E02F 3/086; E02F 3/088; E02F 3/10; E02F 3/142; E02F 5/06; E02F 9/2858; E02F 9/2866

See application file for complete search history.

(56) References Cited

U.S. PATENT DOCUMENTS

| | | | |
|---|---|---|---|
| 568,933 | A | 10/1896 | Wiles |
| 588,051 | A | 8/1897 | Bliss |
| 845,837 | A | 3/1907 | Wines |
| 908,517 | A | 1/1909 | Sturtevant |
| 982,038 | A | 1/1911 | Curry |
| 1,185,504 | A | 5/1916 | Hemenway |
| 1,202,908 | A | 10/1916 | Slauson et al. |
| 1,203,109 | A | 10/1916 | Gitzendanner |

(Continued)

OTHER PUBLICATIONS

Table 2-1, Draft and Power Requirement of Crop Machine, from *Crop-Production Equipment*, p. 20, Mar. 17, 1977.

(Continued)

*Primary Examiner* — Jamie L McGowan

(74) *Attorney, Agent, or Firm* — Leydig, Voit & Mayer, Ltd.

(57) ABSTRACT

A universal cutter assembly comprising a transport device carrying a plurality of freewheeling cutters mounted to freely rotate about an axis, where the axis is canted about two angles with respect to the surface being cut and a line of action imparted by the transport device.

22 Claims, 19 Drawing Sheets

(56) References Cited

U.S. PATENT DOCUMENTS

| | | | | |
|---|---|---|---|---|
| 1,236,445 | A | 8/1917 | Kest | |
| 1,236,909 | A | 8/1917 | Christensen | |
| 1,257,482 | A | 2/1918 | Davidson et al. | |
| 1,294,559 | A | 2/1919 | Sproul | |
| 1,404,835 | A * | 1/1922 | Christine | E21C 25/34 144/123 |
| 1,449,697 | A | 3/1923 | Richards | |
| 1,550,669 | A | 4/1925 | Bowman | |
| 1,555,218 | A | 9/1925 | Kennedy | |
| 1,582,332 | A | 4/1926 | Brutus | |
| 1,586,196 | A | 5/1926 | Halvorsen | |
| 1,618,591 | A | 2/1927 | Jacobsen | |
| 1,651,122 | A | 11/1927 | Hoffert | |
| 1,658,397 | A | 2/1928 | Schmidt | |
| 1,765,602 | A | 6/1930 | McKinlay | |
| 1,845,412 | A | 2/1932 | Hathaway | |
| 1,883,307 | A | 10/1932 | Livingston et al. | |
| 2,025,527 | A | 12/1935 | Schramm | |
| 2,096,875 | A | 10/1937 | Bertovich | |
| 2,149,462 | A | 3/1939 | Oppliger | |
| 2,163,732 | A | 6/1939 | Kleineberg et al. | |
| 2,210,919 | A | 8/1940 | Joy | |
| 2,310,289 | A | 2/1943 | Hokanson | |
| 2,325,455 | A | 7/1943 | Williams | |
| RE22,359 | E | 8/1943 | Christensen | |
| 2,336,335 | A | 12/1943 | Zublin | |
| 2,363,969 | A | 11/1944 | Jones | |
| 2,550,202 | A | 4/1951 | Robbins | |
| 2,634,971 | A | 4/1953 | Schweizer | |
| 2,650,812 | A | 9/1953 | Joy | |
| 2,650,813 | A | 9/1953 | Rollins et al. | |
| 2,659,586 | A | 11/1953 | Leven | |
| 2,676,005 | A | 4/1954 | Joy | |
| 2,693,356 | A | 11/1954 | Hofferth | |
| 2,698,174 | A | 12/1954 | Deuel et al. | |
| 2,709,584 | A | 5/1955 | Kleinberg | |
| 2,720,717 | A | 10/1955 | Arps | |
| 2,736,999 | A | 3/1956 | Rouen et al. | |
| 2,737,378 | A | 3/1956 | Barrett | |
| 2,742,281 | A | 4/1956 | Whitecar | |
| 2,742,439 | A | 4/1956 | Hallett | |
| 2,796,255 | A | 6/1957 | Mitchell | |
| 2,798,712 | A | 7/1957 | Ball | |
| 2,810,567 | A | 10/1957 | Kirkham | |
| 2,856,182 | A | 10/1958 | Cantrell | |
| 2,867,427 | A | 1/1959 | Russell et al. | |
| 2,873,112 | A | 2/1959 | Crafts et al. | |
| 2,926,896 | A | 3/1960 | Krekeler | |
| 2,935,308 | A | 5/1960 | Zorn | |
| 2,939,692 | A | 6/1960 | Russell et al. | |
| 2,966,354 | A | 12/1960 | Gore | |
| 3,039,208 | A | 6/1962 | Oglesby et al. | |
| 3,059,391 | A | 10/1962 | Volks et al. | |
| 3,061,291 | A | 10/1962 | Jones | |
| 3,140,898 | A | 7/1964 | Rogers | |
| 3,176,778 | A | 4/1965 | Bezzerides | |
| RE25,806 | E | 6/1965 | Oglesby et al. | |
| 3,295,232 | A | 1/1967 | Oglesby et al. | |
| 3,299,232 | A | 1/1967 | Oglesby et al. | |
| 3,361,481 | A | 1/1968 | Maddock | |
| 3,397,012 | A | 8/1968 | Krekeler | |
| 3,397,013 | A | 8/1968 | Krekeler | |
| 3,471,950 | A | 10/1969 | Ferwerda | |
| 3,493,268 | A | 2/1970 | Bower, Jr. | |
| 3,498,677 | A | 3/1970 | Morrow | |
| 3,512,838 | A | 5/1970 | Kniff | |
| 3,519,309 | A | 7/1970 | Engle et al. | |
| 3,554,605 | A | 1/1971 | Elders | |
| 3,627,381 | A | 12/1971 | Krekeler | |
| 3,650,565 | A | 3/1972 | Kniff | |
| 3,652,130 | A | 3/1972 | Elders | |
| 3,658,318 | A | 4/1972 | Bunting et al. | |
| 3,663,007 | A | 5/1972 | Preiter | |
| 3,663,063 | A | 5/1972 | Johnmeyer, Sr. | |
| 3,679,265 | A | 7/1972 | Krekeler | |
| 3,695,726 | A | 10/1972 | Krekeler | |
| 3,697,137 | A | 10/1972 | Krekeler | |
| RE27,686 | E | 6/1973 | Kniff | |
| 3,746,396 | A | 7/1973 | Radd | |
| 3,749,449 | A | 7/1973 | Krekeler | |
| 3,752,534 | A | 8/1973 | Rollins et al. | |
| 3,767,266 | A | 10/1973 | Krekeler | |
| 3,778,112 | A | 12/1973 | Krekeler | |
| 3,784,259 | A | 1/1974 | Munger et al. | |
| 3,787,091 | A | 1/1974 | Paolini et al. | |
| 3,796,464 | A | 3/1974 | Hansen et al. | |
| 3,801,158 | A | 4/1974 | Redd et al. | |
| 3,807,803 | A | 4/1974 | Rollins et al. | |
| 3,820,848 | A | 6/1974 | Kniff | |
| 3,833,264 | A | 9/1974 | Elders | |
| 3,833,265 | A | 9/1974 | Elders | |
| 3,841,707 | A | 10/1974 | Kniff et al. | |
| RE28,310 | E | 1/1975 | Krekeler | |
| 2,865,437 | A | 2/1975 | Crosby | |
| 3,888,133 | A | 6/1975 | Krekeler | |
| 3,913,979 | A | 10/1975 | Strauss et al. | |
| 3,926,423 | A | 12/1975 | Merker et al. | |
| 3,945,681 | A | 3/1976 | White | |
| 3,954,301 | A | 5/1976 | Stepp | |
| 3,957,307 | A | 5/1976 | Varda | |
| 3,968,995 | A | 7/1976 | Arentzen | |
| 3,979,843 | A | 9/1976 | Nissen | |
| 3,988,016 | A | 10/1976 | Merker et al. | |
| 3,992,061 | A | 11/1976 | Rollins | |
| 4,244,625 | A * | 1/1981 | Turner | E21C 35/18 299/83.1 |
| 4,448,269 | A | 5/1984 | Ishikawa et al. | |
| 1,903,772 | A | 4/1993 | Bowman | |
| 5,338,102 | A * | 8/1994 | Lent | E02F 9/02 299/10 |
| 5,605,382 | A * | 2/1997 | Massa | E21C 35/1933 299/107 |
| 7,690,138 | B2 * | 4/2010 | Hall | E02F 3/142 175/371 |
| 7,950,170 | B2 | 5/2011 | Hall et al. | |
| 9,828,742 | B2 * | 11/2017 | Hagenbuch | E02F 5/06 |
| 2008/0163523 | A1 | 7/2008 | Seidl et al. | |
| 2008/0282584 | A1 | 11/2008 | Hall et al. | |
| 2010/0107455 | A1 | 5/2010 | Hall et al. | |

OTHER PUBLICATIONS

"Disk Tools", Chapter 12 from *Crop-Production Equipment*, pp. 138-147, Mar. 17, 1977.

"Disk Implements", Chapter 7 from *Principles of Farm Equipment*, pp. 153-168, received Mar. 17, 1977.

Article entitled: "More Miles of tunnel. More Miles of Shafts and Raises. More than 300 Machines Worldwide" from *Robbins Company*, Jan. 1981 (p. 82).

Article entitled "Chicago's Grand Plan Imperiled", ENR/Dec. 17, 1981, p. 33.

Article entitled: "When Rock Talks, We Listen" from *Timken Company*, p. 116, Jan. 1981.

Article entitled:"Ripperveyor Cutter Head Gives Higher Production, Better Clean-Up" from *Joy Manufacturing Company*, inventor first became aware of this in early 1981.

Article entitled "Depend on McNally Repairs to Minimize Equipment Replacement", *Mc Nally Mountain States Steel Co.*, p. 17, Jul. 1981.

Article entitled "Take another look at our—There's more than meets the eye—hidden benefits such a proven new approaches to productivity—significant reliability and safety benefits", *Jeffrey Mining Machinery Division Dresser Industries, Inc.*, inventor first became aware of this in early 1981.

Article entitled "Kennametal Tools for Road Planning", pp. 10, 11, and 13-15, inventor first became aware of this in early 1981.

Roto-Mill PR-750 Pavement Profiler, Features and Specifications, inventor first became aware of this in early 1981.

Pengo Corporation—Interchangeable Teeth, *Bulletin* 114, 1977.

Article entitled "Straight Creek Miners Discover 6,354 Extra Fee on A Hughes HH44", *Huges Toll Company*, inventor first became aware of this in early 1981.

(56) References Cited

OTHER PUBLICATIONS

Austin Drill Heads, Speed Auger and Air Drilling, *Austin Power Company*, LL-9724, inventor first became aware of this in early 1981.
H&L Tooth Company, Litho, US, *Brochure HL-227A* (pp. 7, 9, 13 & 15), inventor first became aware of this in early 1981.
Pengo Augers, For use on all makes of boring machines, for use on all types of boring machines, fast digging in all kinds of material, Designed fro Strength and durability, *Bulletin 92A*, 1978.
*Hensley Ripping Attachments*, inventor first became aware of this in early 1981.
Wain Roy, *Ripper Bucket, Excavate callches, coral, frost, limestone, sandstone and shale* (1 page), inventor first became aware of this in early 1981.
*Information Cones with Carbide button Tips* (2 pages), inventor first became aware of this in early 1981.
*ESCO, Ground Engaement Tools* (1 pages), inventor first became aware of this in early 1981.
*Tradeshow Pictures* (1 page), inventor first became aware of this in early 1981.
Alpine Cutters, "Rock & Concrete Cutter", *MCS Magazine* (Modern Contractor Solutions), Oct. 2013 (1 page).
Altcut Products, "Flat Face Carbide Cutters", retrieved from http:www.altcutproducts.com/item.php?pageid=ffctfail&units on Jan. 30, 2009 (1 page).
Grayson, Wayne, "Baby Bertha? Bechtel builds mimi tunnel-boring machine using 50,000 Legos". *Construction News*, retrieved from http:www.equipmentworld.com/video-baby-bertha-bechtel-builds-mini-tunnel-boring-ma . . . on Feb. 10, 2014 (1 page).
Grayson, Wayne, "Big Bertha, world's largest tunnel-boring machine arrives in Seattle", on Apr. 4, 2013, *Construction News* retrieved from http:www.equipmentworld.com/bi-bertha-worlds-largest-tunnel-boring-machine-arrives . . . (Feb. 10, 2014) (3 pages).
Coneqtec Univerisal—"Call you dealer to fine out about new reduced prices", *Slot Cutters*, retrieved from http:www.coneqtecuniversal.com/slotcutter.html on Jan. 30, 2009, (10 pages).
Duratooth Combos110K Chains, *Ditch Systems Parts Catalog*, 2013 (3 pages).
Kirian, Denny, "DK-628 Chain Trencher". Done Right, inventor first became aware of this article in 2000. (3 pages).
"Introducing the New SL 900", A Wining Combination: High Productivity, High Availability and EiControl Automation, 2 page from *Coal Age Magazine*, Apr. 2011.
Jeffrey Machine, Inc., "Drilling Tools Field Guid", pp. 5-9, 30, 36-42, 46 and 52-53, © 2011-2012, *Jeffrey Machine Inc.* (18 pages).
Marais Groupe, SMC 200 R Wheel Trencher for the mechanical laying of networks, *Product Brochure*, Feb. 2006, (10 pages).
Mastenbroek Technologies Novatrice, *Product Brochure*, HRT, 2006 (4 pages).
Mastenbroek, *Rock Trenchers*, Mastenbroek rock trenchers combine innovative and roust design together with quality components and the versatility afforded by a variety of installation systems, Apr. 2014 (6 pages).
Port Industries, Hydramaxx 2500, 2600 and 2400, *Product Brochure*, Jan. 1, 2007 (6 pages).
Rivard *Product Brochure* for "RIV 503 TR 250 Rock Saw Wheel Trencher", 2009, (4 pages).
Rivard *Product Brochure* for Trancheuse 500 ch and RIV 523 TR 250, Wheel Trenchers, 2009 (4 pages).
Smith Manufacturing website information, retrieved from http://www.smithmfg.com on Jan. 30, 2009 (2 pages).
TESMEC, USA, Inc., 775DT "Dirt Series", *Product Brochure*, Aug. 1, 2013, (2 pages).
Roepke, Wallace W., et al., "Bureau of Mines Coal Cutting Technology Facilities at the Twin Cities Research Center", *Bureau of Mines Information Circulr/* 1983, Information Circular 8951 (31 pages).
United States Department of the Interior Bureau of Mines, *Mounting Post Drawing*, Feb. 25, 1988, (1 page).
Vermeer, T1655 Terrain Leveler® *Surface Excavation Machine*, ©2012, (6 pages).
Vermeer, "Our Newest High Performance Machine, This is Where the Name of the Machine Matters Most", pages from *International Mining Magazine*, May 2011, (2 pages).
Vermeer Risa Trancheuses Et *Equipment Brochure*, © 2001, (3 pages).
Vermeer Utility Tracker, RTX 1250 *Product Brochure*, © 2009, (6 pages).
International Search Report and Written Opinion for co-pending International Application No. PCT/US2015/13997 dated Apr. 23, 2015.
Article entitled "Earth Materials", from Wikipedia, the free encyclopedia, retrieved from https://en.wikipedia.org/wiki/Earth_materials#Definitions, Sep. 19, 2016.
International Preliminary Report on Patentability for co-pending International Application No. PCT/US2015/13997, dated Aug. 11, 2016.
Disc Blades, Disc Harrow Blades, Notched and Plain, retrieved from Home/Grizzly® Brand, AGRI Supply—Shop—Home, retrieved (http://www.agrisuplly.com/grizzly/c/8000005), (2016), (7 pages).
Kepner, R.A., et al., Principles of Farm Machinery, Second Edition, "Disk Implements", Chapter 7, *The AVI Publishing Company*, Inc., 1972, (pp. 153-160).
Richey, C.B., et al., Agricultural Engineers Handbook, "*Disk Tools*", Chapter 13, McGraw-Hill Book Company, Inc., 1961, (11 pages).
"Disc Harrow Requirements", Equipment How-to, *Small Farmers Journal*, (6 pages), originally appeared in Small Farmers Journal, Issue 28-3 (2016).

* cited by examiner

CUTTER ASSEMBLY WITH FREEWHEELING CUTTING ELEMENTS

CROSS REFERENCE TO RELATED APPLICATIONS

This application is a continuation-in-part of U.S. application Ser. No. 14/611,161, filed Jan. 30, 2015, which is expressly incorporated by reference herein in its entirety and which claims the benefit of U.S. Provisional Application No. 61/934,476, filed Jan. 31, 2014, U.S. Provisional Application No. 61/947,749, filed Mar. 4, 2014, and U.S. Provisional Application No. 62/010,171, filed Jun. 10, 2014, which are also expressly incorporated by reference herein in their entireties.

FIELD

The present invention generally relates to earthen material cutter assemblies and, more particularly, to cutter assemblies which are useful in trenching machines, boring machines, road profiling machines and similar earthen material cutting applications.

BACKGROUND

One of the difficulties with present earthen material cutter assemblies is that the material cutters are generally not capable of cutting and penetrating certain extremely hard earthen materials, such as reinforced concrete, rocks, or frozen earth, or at best such materials are simply crushed very slowly and/or with a high rate of wear by brute force. Consequently, displacing or removing extremely hard earthen materials by crushing is an extremely costly undertaking today, and in many cases is simply not economically feasible.

SUMMARY

In accordance with the present invention, there is provided a cutter assembly for use in earthen material removal, such as in trenching, road profiling and the like. In one embodiment, the invention provides a transport device carrying a plurality of cutting stations in order to drive the cutting stations in a direction of movement. The cutting stations include freewheeling cutters that rotate about an axis of rotation. The cutter axis of rotation of at least some of the cutters is canted by a tilt angle toward a plane of the surface being cut and is also canted by a side angle toward the direction of movement. Each freewheeling cutter includes a cutting surface with cutter points that point outward from the respective cutter axis of rotation. The cutter points are disposed at an angle relative to the cutter axis of rotation.

Other aspects and advantages of the invention will be apparent from the following detailed description and the accompanying drawings.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following:

FIG. 3D-1 depicts the bottom cutters of the first side cutter station;

FIG. 3D-2 depicts the side cutters of the first side cutter station;

FIG. 3E-1 depicts the bottom transition support cutters of the second side cutter station;

FIG. 3E-2 depicts the second trenching side cutters of the second side cutter station;

DETAILED DESCRIPTION

An aspect of the present invention is to provide an improved earthen material cutter assembly which is capable of cutting a variety of different earthen materials, and is particularly well suited to cut through extremely hard earthen materials.

Embodiments of the invention provide an improved cutter assembly which is capable of cutting through extremely hard earthen materials with a high degree of cutting efficiency and, therefore, at relatively fast cutting rates, e.g., at rates of up to six to twelve inches per minute or greater through high-strength concrete of various thickness. In this connection, an aspect of the invention is to provide such a cutting assembly which produces a unique cutting action that fractures the material being cut by subjecting the material primarily to tensile forces rather than crushing compressive forces.

One embodiment of the invention provides a cutter assembly, in which the cutters have a relatively long operating life, thereby minimizing the down time for periodic replacement of the cutters.

Turning now to FIGS. 1-12, which illustrate embodiments of a cutter assembly that is part of a trencher, where the cutting stations are mounted on a chain that operates as the transport device of the cutter assembly. The embodiments suitably describe many aspects and advantages of the operation of a cutter assembly that utilizes the present invention. However, the cutter assembly of the present invention is certainly not limited to trenching. For example, the cutter assembly could be mounted on other transport devices, such as a rotating drum, a reciprocating blade or arm, a rotating wheel, or on the end of a rotating shaft or tube.

Figure 1:
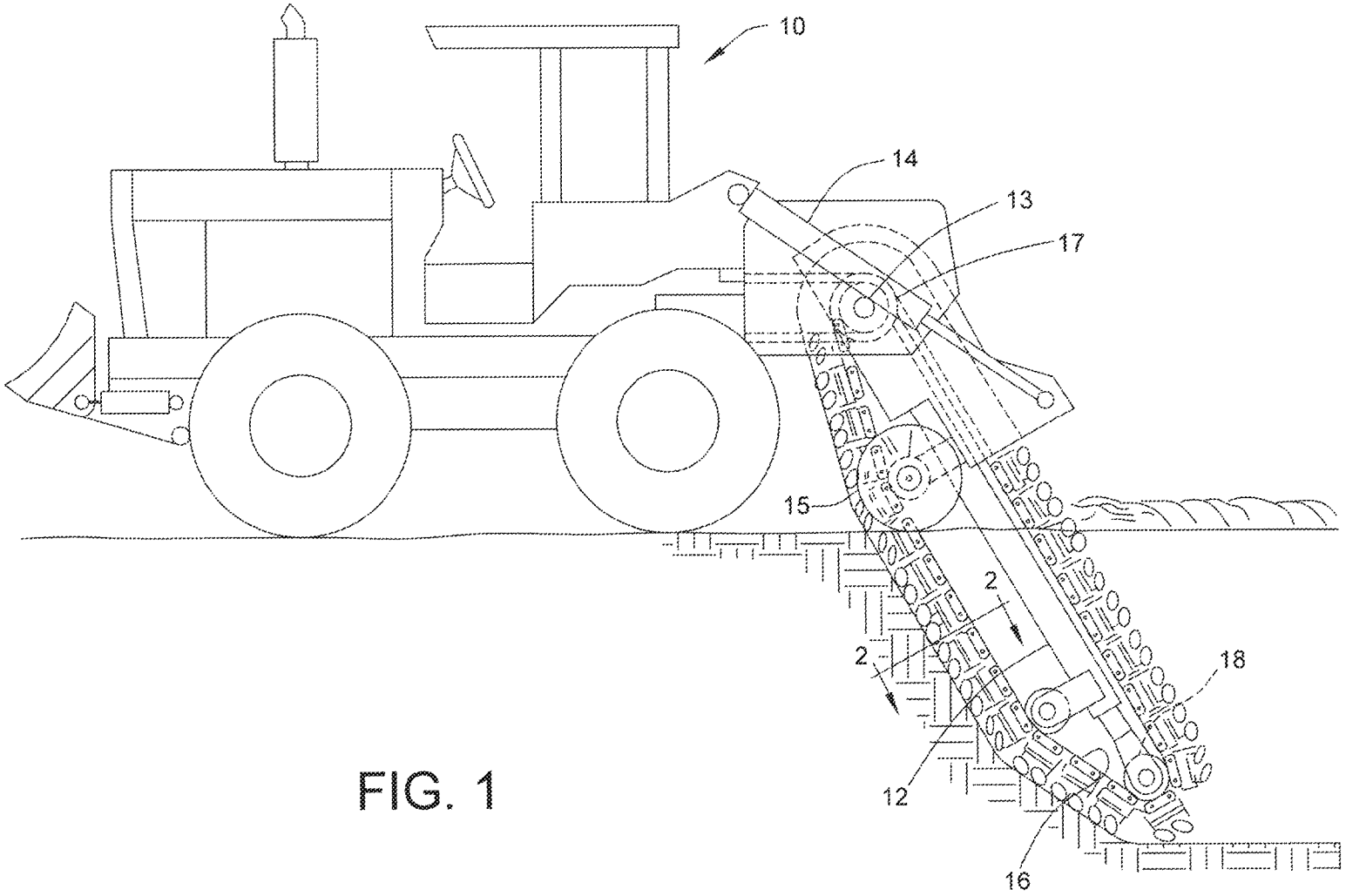
FIG. 1 is a side elevation of a trenching machine utilizing cutters in accordance with one embodiment of the present invention.

Referring first to FIG. 1, there is shown a trenching machine 10. The trencher includes a boom 12 pivoted on a shaft 13 so that the trencher boom can be raised and lowered by means of a hydraulic cylinder 14. As material is excavated by the trencher the material is brought to the surface, moved laterally by means of an auger 15, and deposited along one or both sides of the trench. Alternatively, the material brought to the surface could be moved laterally by other devices, such as a conveyor. The trenching machine can include a conventional boom, as shown in FIG. 1, or it can include a frost bar boom, or in some cases it can be a rock saw wheel that carries the cutter mount assemblies when cutting through harder earthen materials.

In the particular embodiment illustrated, a series of cutting stations of the cutter assembly are carried by an endless chain trained about a drive chain sprocket 17 at the upper end of the boom 12, and an idler sprocket 18 at the lower end of the boom 12. The cutter carrier chain 16, which is driven in the clockwise direction as viewed in FIG. 1, serves as the driven transport device or carrier for the cutter assembly with the cutter stations. Each link 19 of the cutter carrier chain 16 is equipped with mounting plates 20 (see FIG. 2) which are connected to carrier plates 22 of the cutting stations using bolted connections 23.

Figure 2:
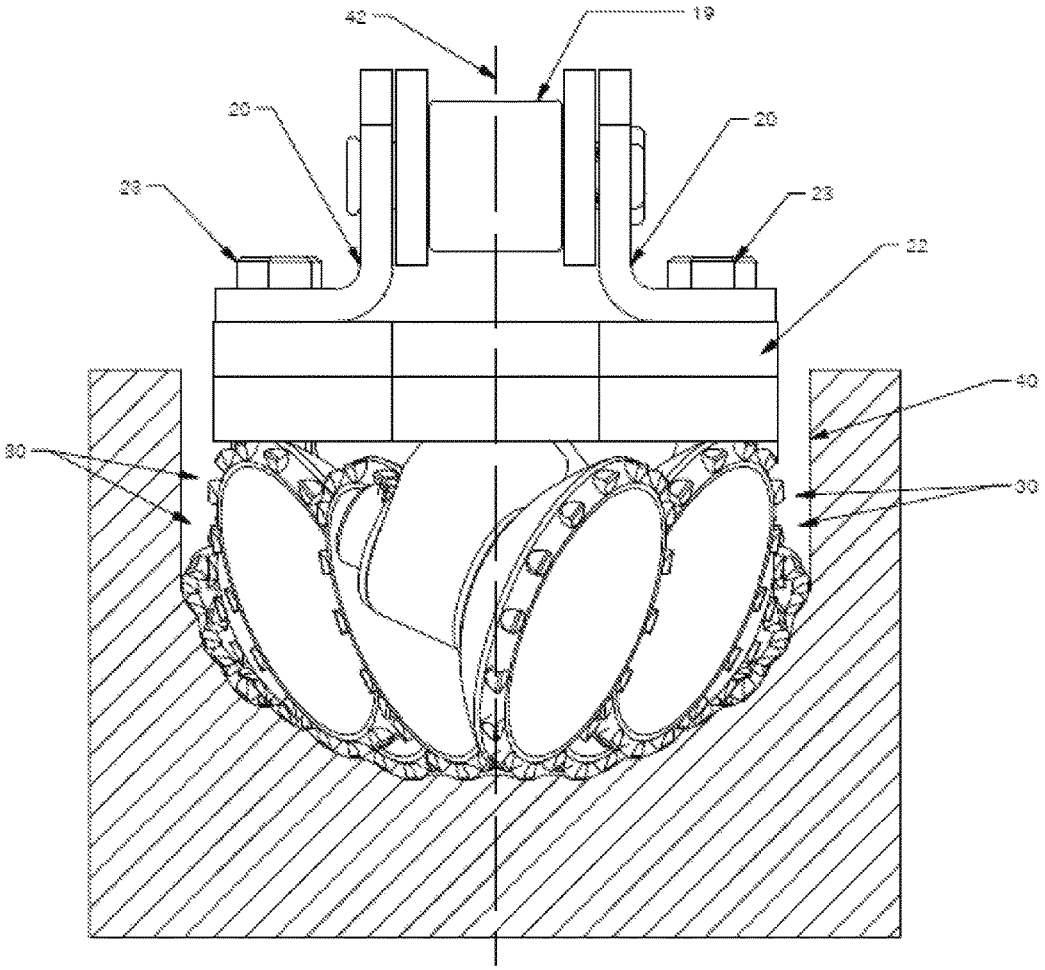
FIG. 2 is an enlarged section taken generally along the line 2-2 in FIG. 1.
Figure 10:
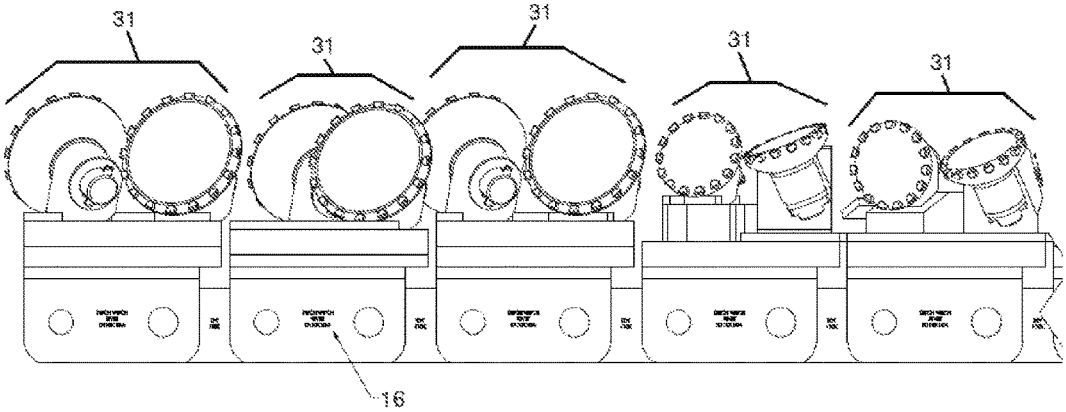
FIG. 10 is a side view of the trench cutter stations shown in FIGS. 3A-3E.
Figure 11:
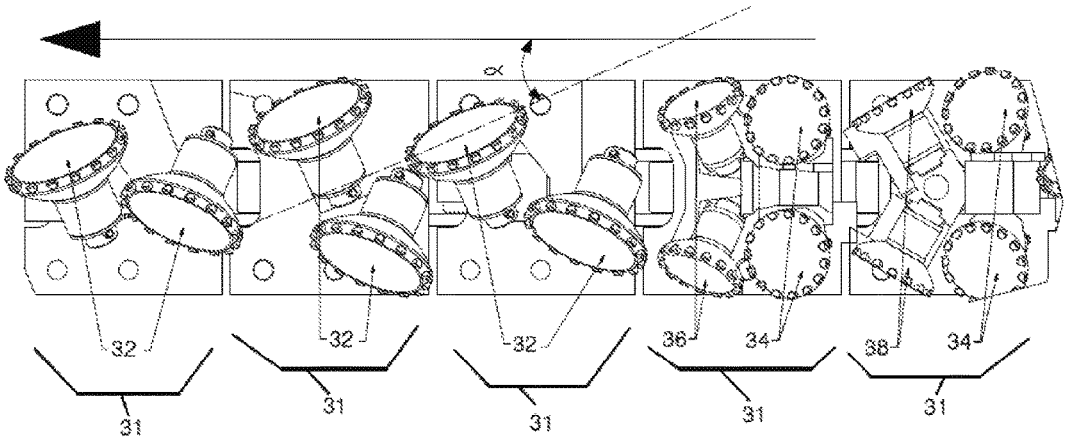
FIG. 11 is a top view of the trench cutter stations shown in FIG. 10.

The illustrated cutters 30 in FIG. 2 are organized in stations, each of which is attached by a carrier plate 22 to a separate link 19 of the cutter carrier chain 16. Generally, as used herein, the term cutting station refers to one or more cutters disposed at a certain position along the transport device with respect to the direction of movement of the transport device. It should be understood that the term cutting station is defined such that the cutters in a cutting station are adjacent to one another. Further the term cutting station includes the freewheeling cutters 30, as well as any mounts, spacers or carrier plates that attach the cutters 30 to the transport device. In the illustrated embodiment, the cutting stations include carrier plates 22 for attachment to respective links 19 on the cutter carrier chain 16. Accordingly, each cutting station with freewheeling cutters moves as a unit around the boom 12 in FIG. 1. By moving around the boom, the cutting stations with freewheeling cutters collectively form a trench having the trench profile 40 shown in FIG. 2. To form the trench, a series of different cutting stations are sequenced on the cutter carrier chain 16, and each cutting station operates on a different section of the trench profile 40. In many embodiments, the series of stations will repeat around the chain length. However, it is also possible that each of the cutting stations around the chain has a unique configuration. When the stations are in series and repeat, it is preferable that there are at least three stations in a series. In the illustrated embodiment, the series includes five stations (FIGS. 10 and 11).

The illustrated cutters are arranged in opposing pairs, where each of the cutters 30 function as a pair operating on opposing sides of the trench. The use of opposing cutters 30 maintains cutter balance during the trench cutting action. In the illustrated embodiment all of the cutters are arranged in opposing pairs. However, it is also possible for the cutter assembly to include cutters 30 that are not paired. Preferably, however, the majority of the cutters are arranged in pairs. In some embodiments, a vast majority, i.e., more than 75%, of the cutters may be paired.

The cutters 30 in an opposing pair act on mirrored points about the trench centerline along the periphery of the trench profile 40. To achieve such mirrored action, the cutters in a pair are each disposed at the same depth, where the depth of the cutter is defined herein by the distance of the cutter from an outer surface of the transport device. Thus, in the illustrated embodiment, the depth of each cutter is defined by the distance of the cutter from the mounting plate 20 of the carrier chain link 19. Likewise, if the cutter assembly is formed on a rotating wheel, the depth of the cutter would be defined by the distance of the cutter from the edge of the rotating wheel circumference. The cutting depth of each cutting element also characterizes how deep the cutters penetrate into the trench, independent of the position of the boom or cutting wheel. In addition to having the same depth, it is preferable that the cutters in a pair are also disposed at the same lateral offset distance from a centerline 42 of the cutter assembly.

To maintain the aforementioned balance, the paired cutters may be positioned horizontally from a centerline 42 of the cutter station at the same location along the length of the cutter carrier chain 16, i.e., in the direction of movement of the chain. It is also possible that the paired cutters are disposed at different distances along the length of the cutter assembly. However, it may be understood that "paired" cutters are adjacent to one another with respect to the direction of movement of the cutter carrier chain 16.

As can be seen in FIG. 2, the trench profile 40 has a tapered shape, with the center of the trench profile 40 having a slightly deeper depth than the sides of the trench profile 40. It should be understood that the term trench profile 40, as used herein, is the shape of the trench in a plane that is orthogonal to the direction of cutter assembly movement. For example, the plane of the images shown in FIG. 2. The tapered profile shape of the trench shown in FIG. 2 allows the cutter stations focused on the center of the trench profile 40 to alleviate stress on the cutters 34, 38 that operate further outward toward the lateral sides of the trench profile (FIGS. 3D-3E). The shape of the trench profile 40 is provided by differing depth and lateral positions of the cutters, as shown in FIGS. 3A-3E.

Figure 3A:
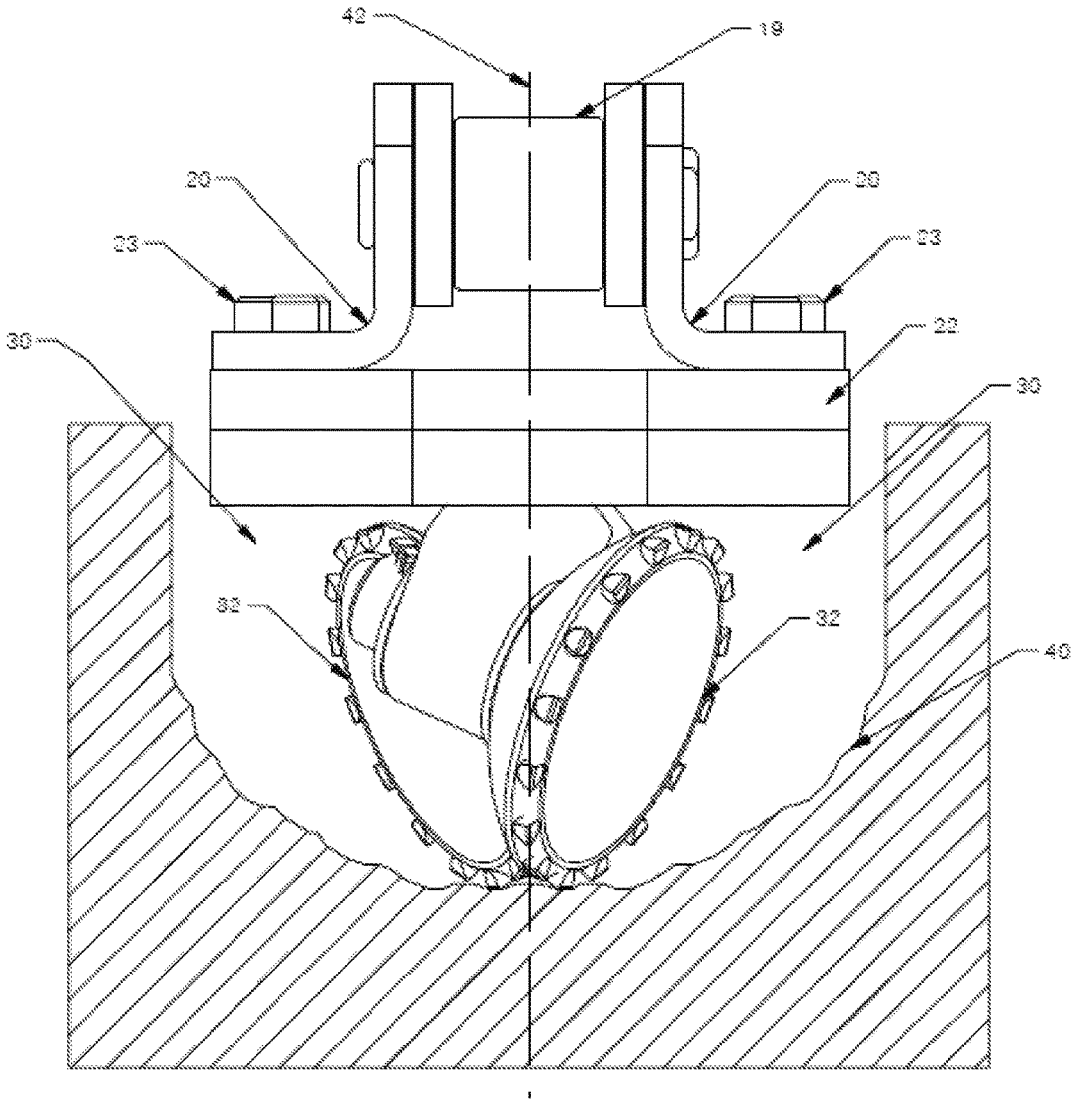
FIG. 3A depicts a first trench bottom cutter station arranged on a link of a driven chain of the trenching machine.
Figure 3B:
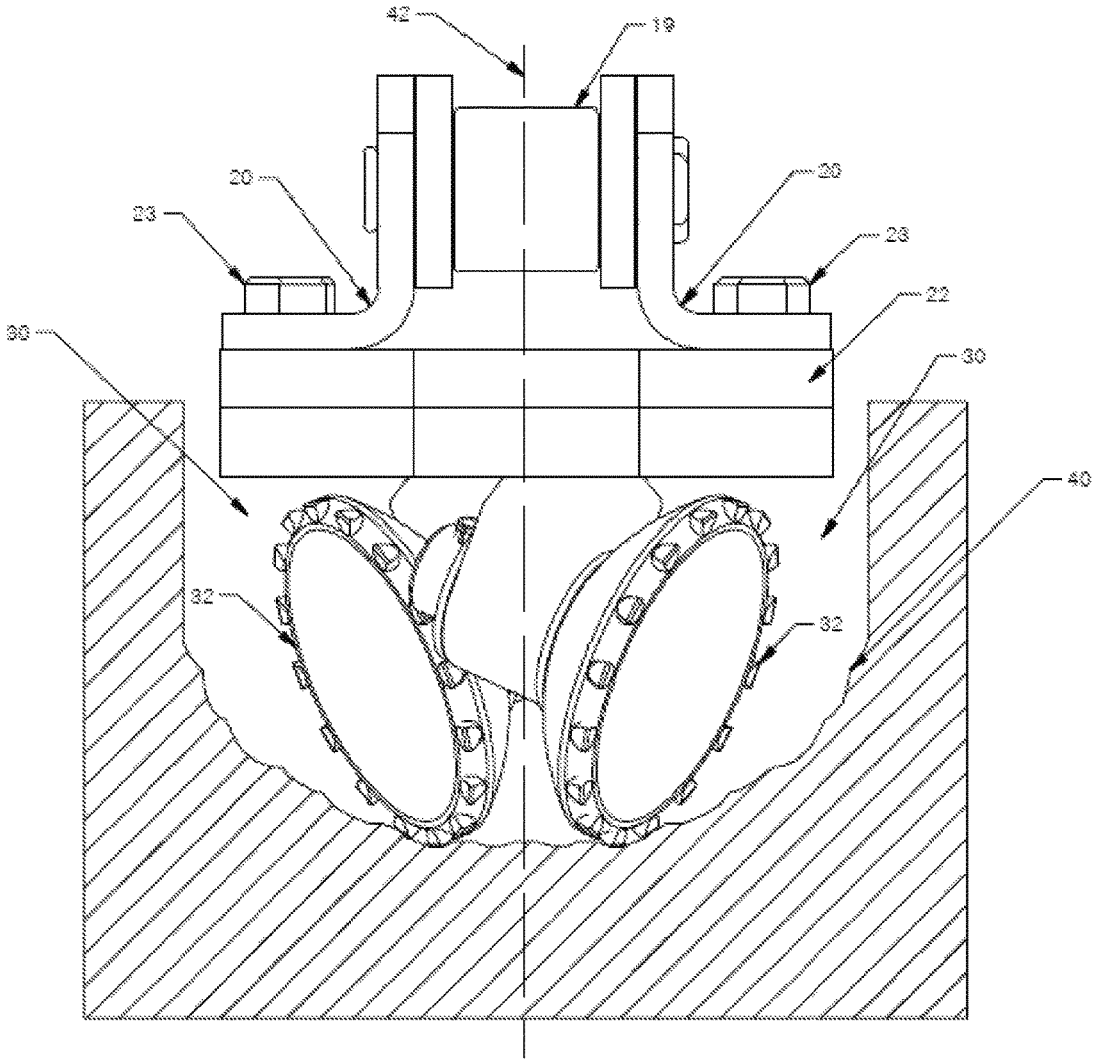
FIG. 3B depicts a second trench bottom cutter station arranged on another link of the driven trenching chain.
Figure 3C:
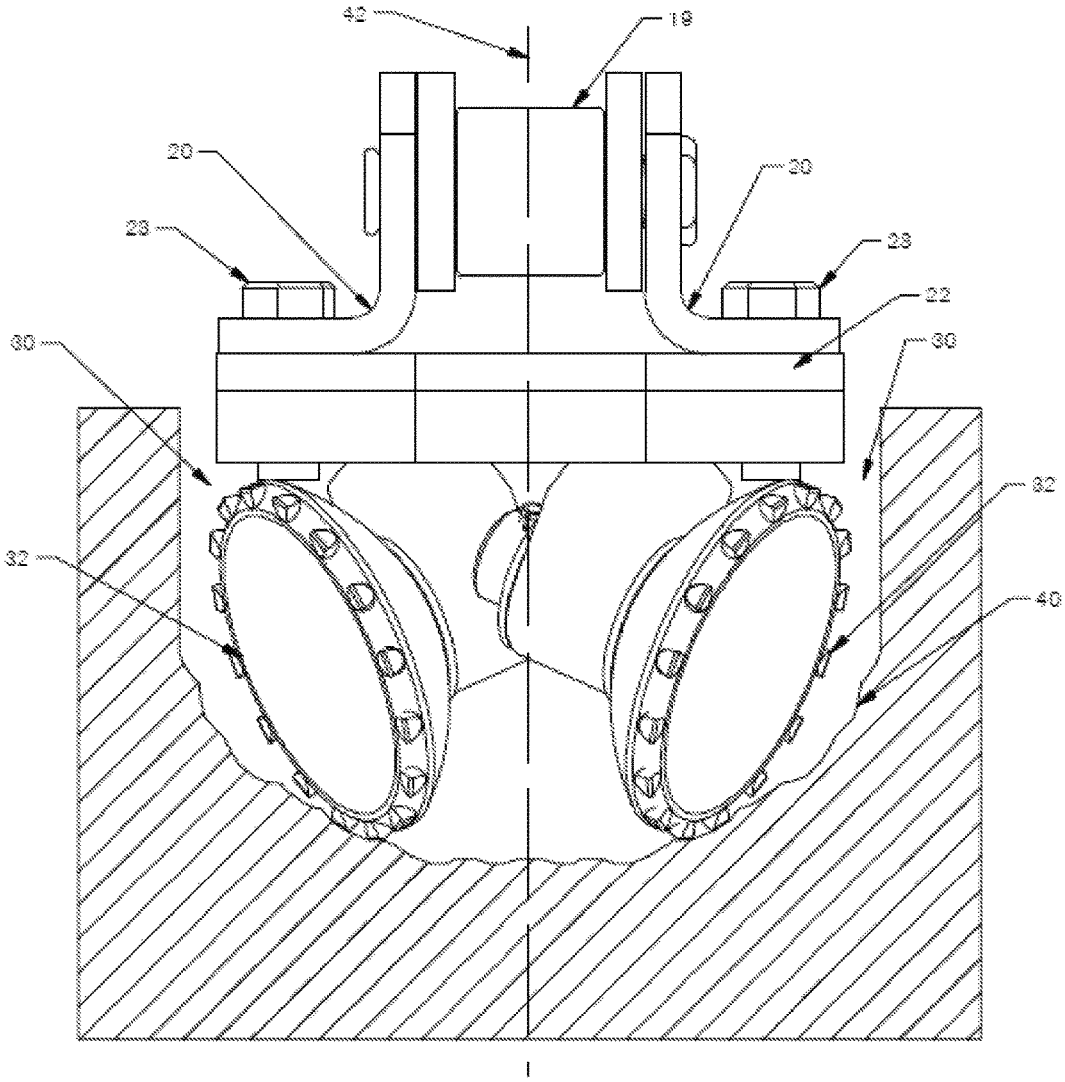
FIG. 3C depicts a third trench bottom cutter station arranged on yet another link of the driven trenching chain.
Figure 3D:
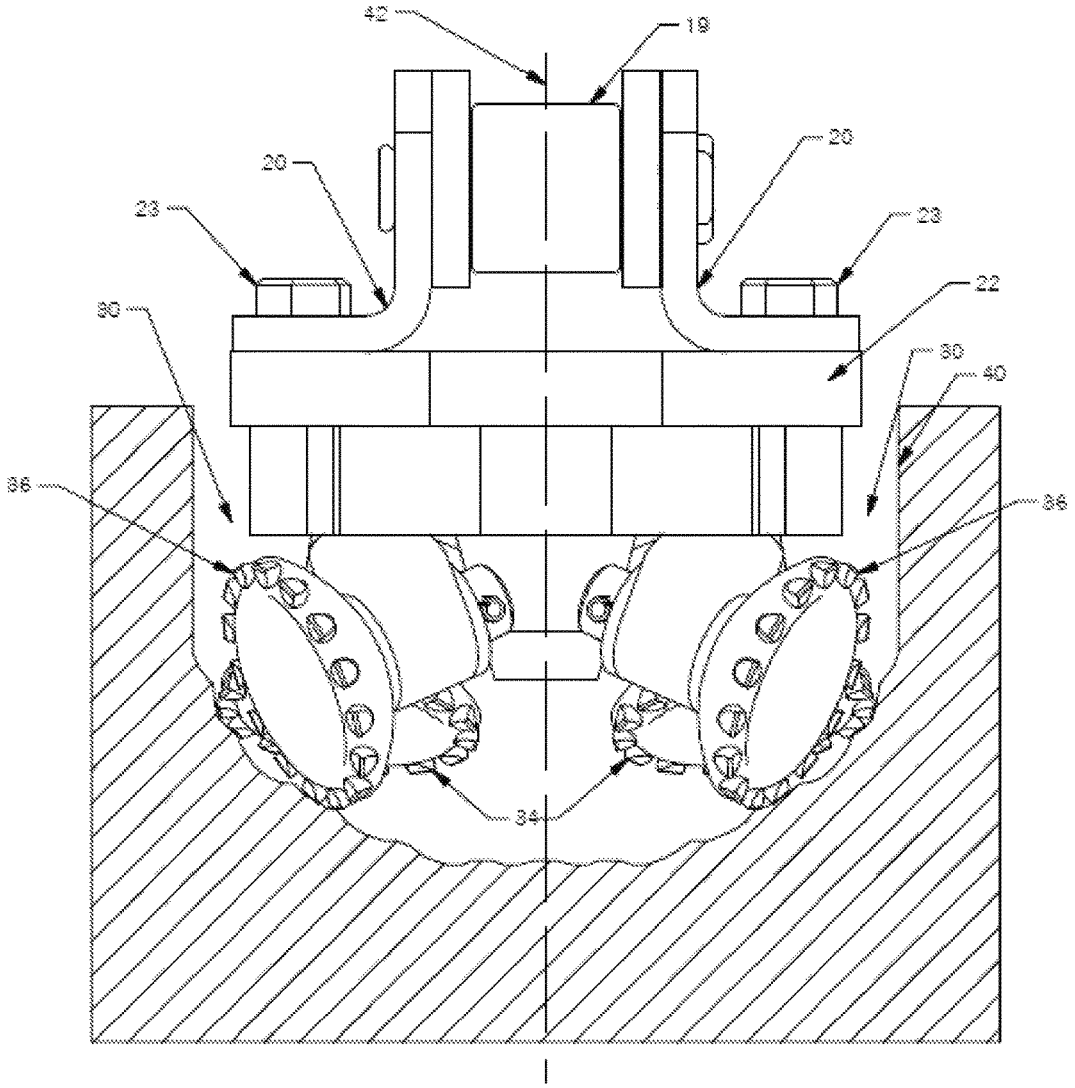
FIG. 3D depicts a first trenching side cutter station arranged on another link of the driven trenching chain.
Figures 1, 3D:
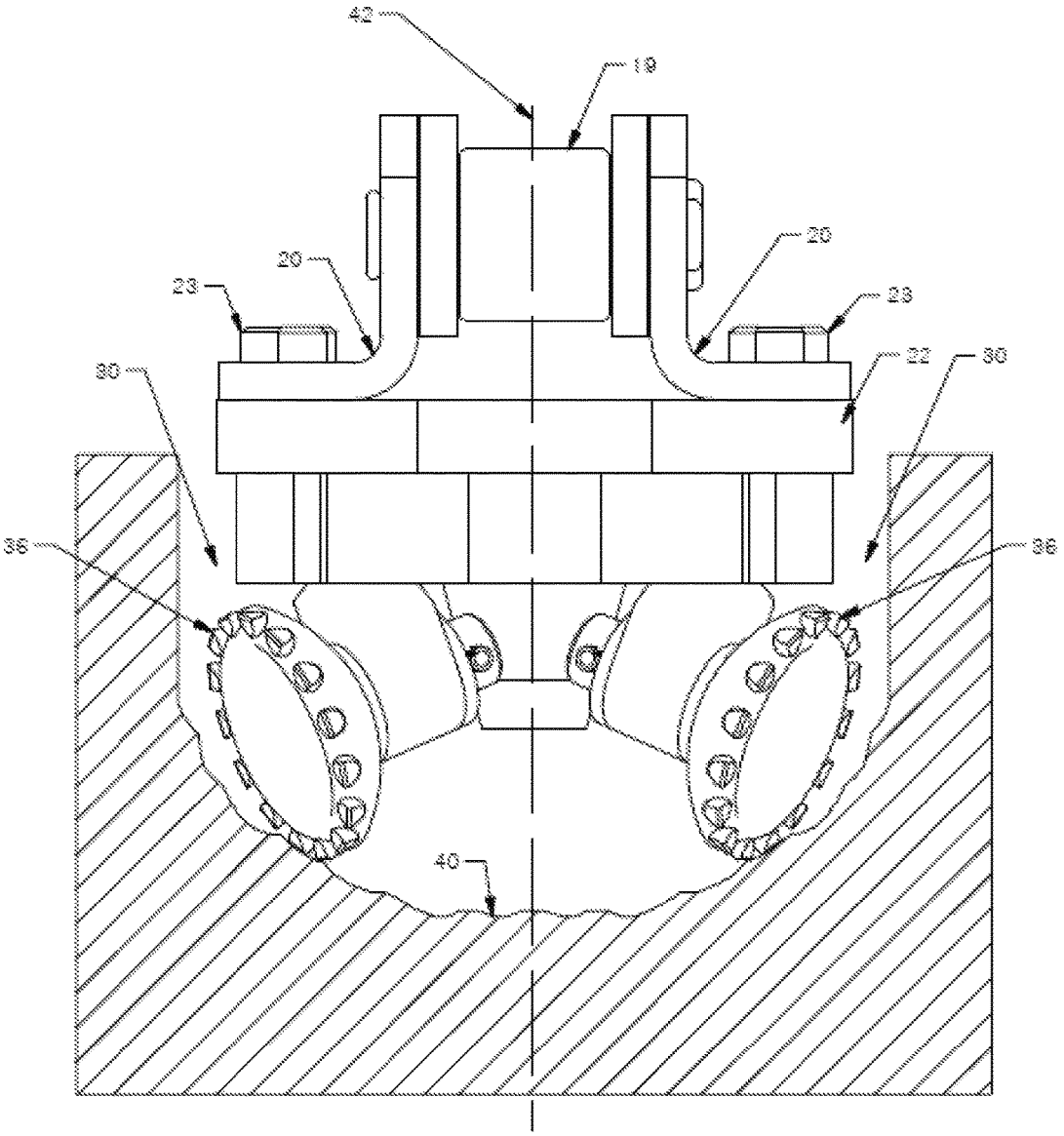
Figures 2, 3D:
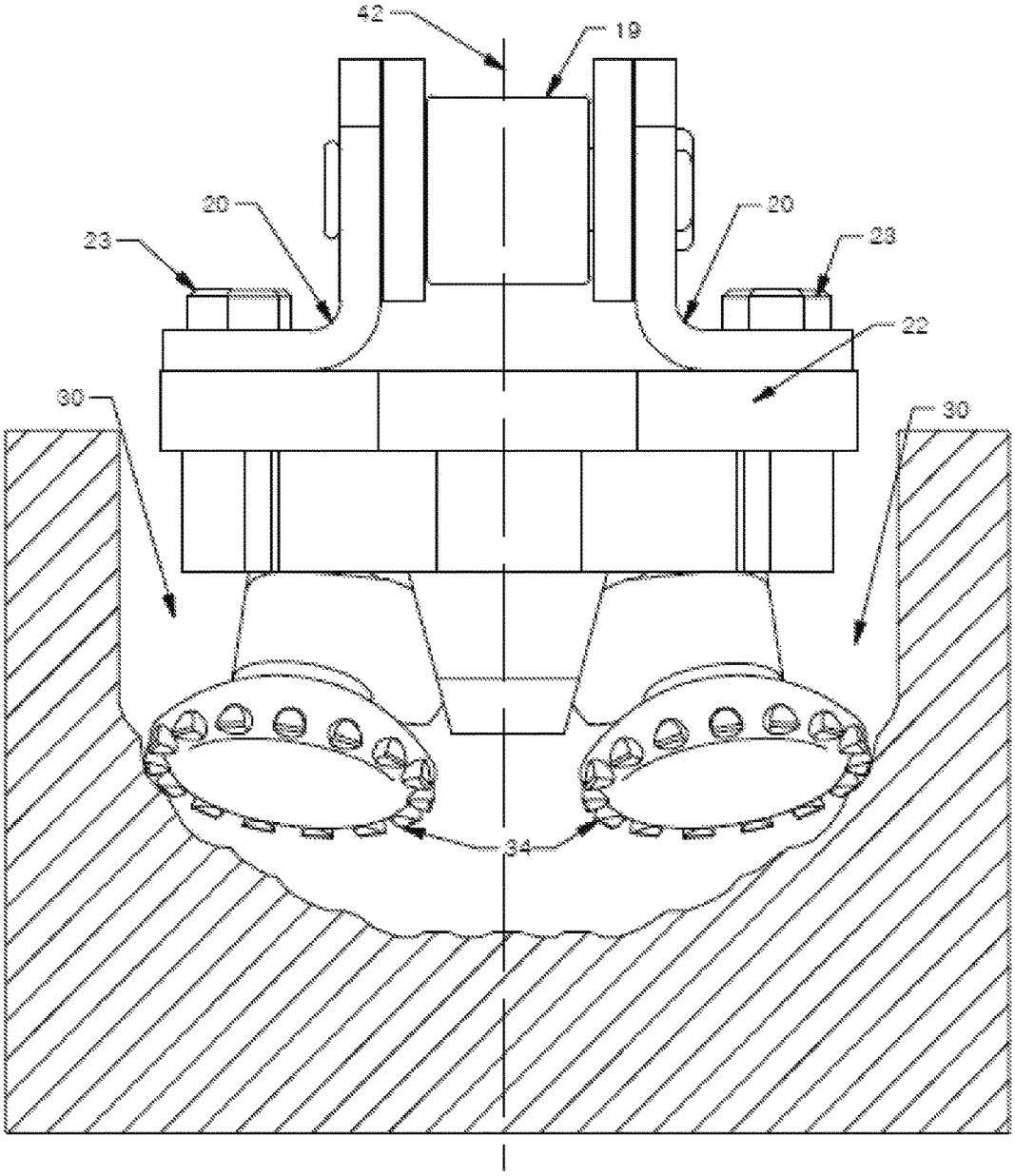
Figure 3E:
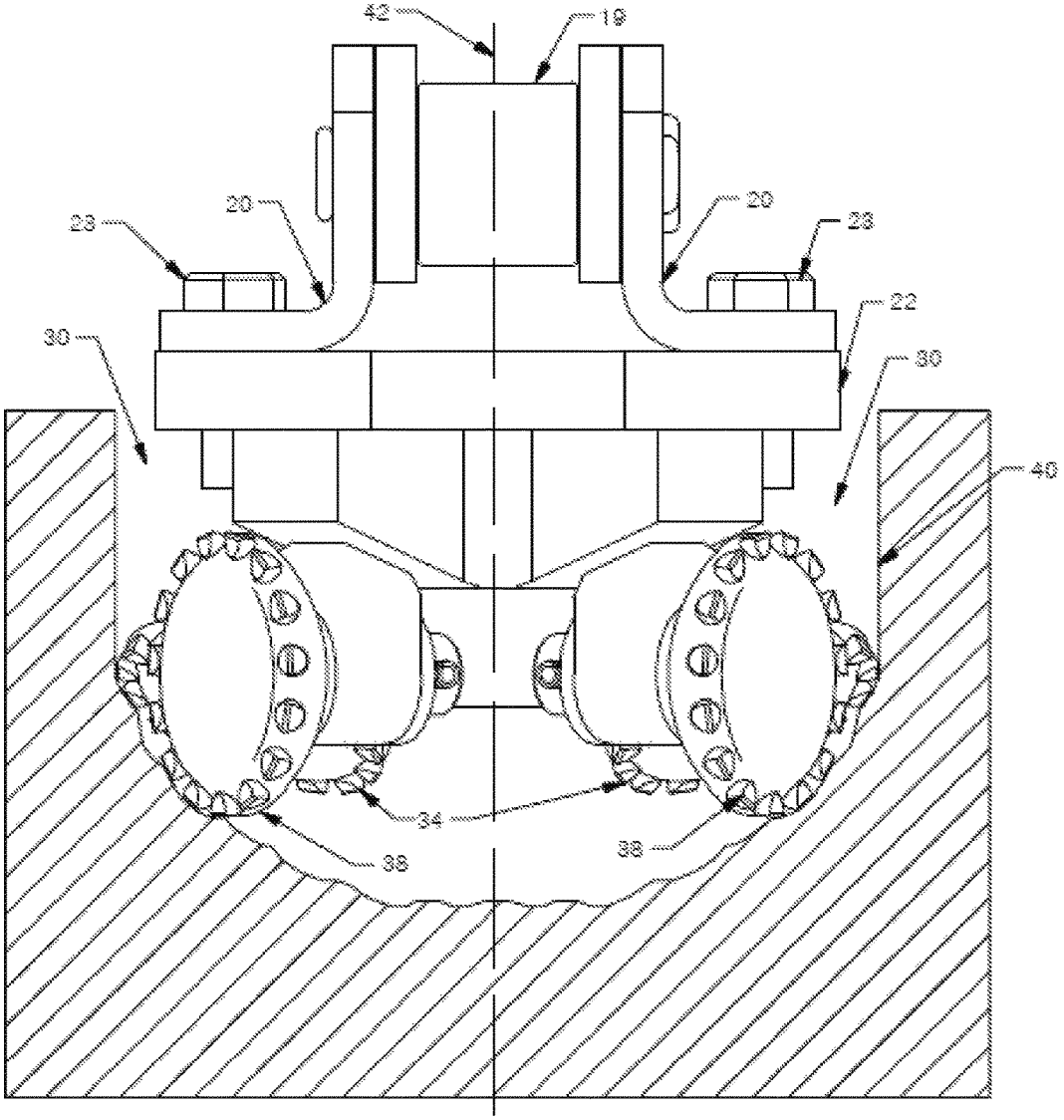
FIG. 3E depicts a second trenching side cutter station arranged on still another link of the driven trenching chain.
Figures 1, 3E:
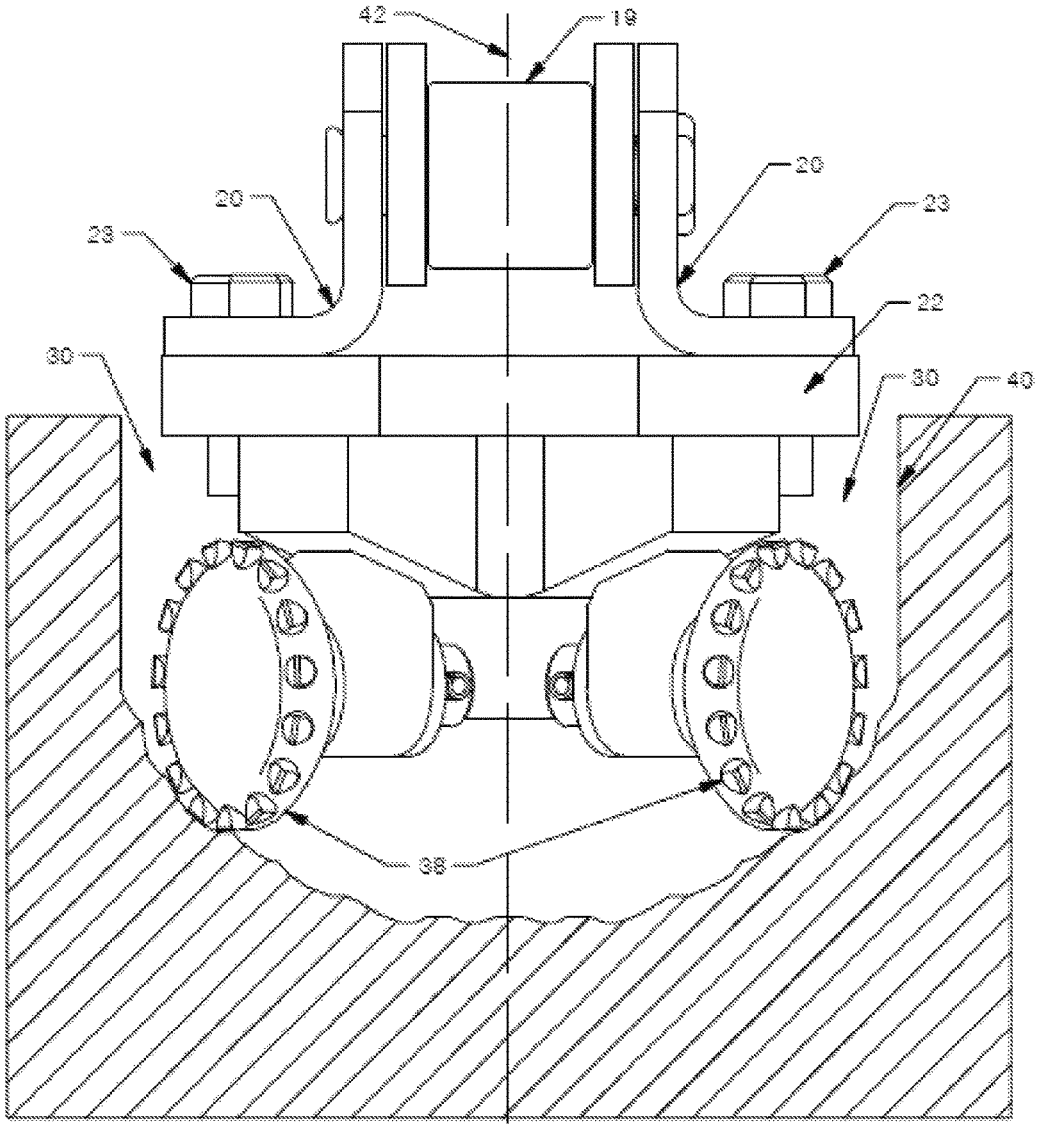
Figures 2, 3E:
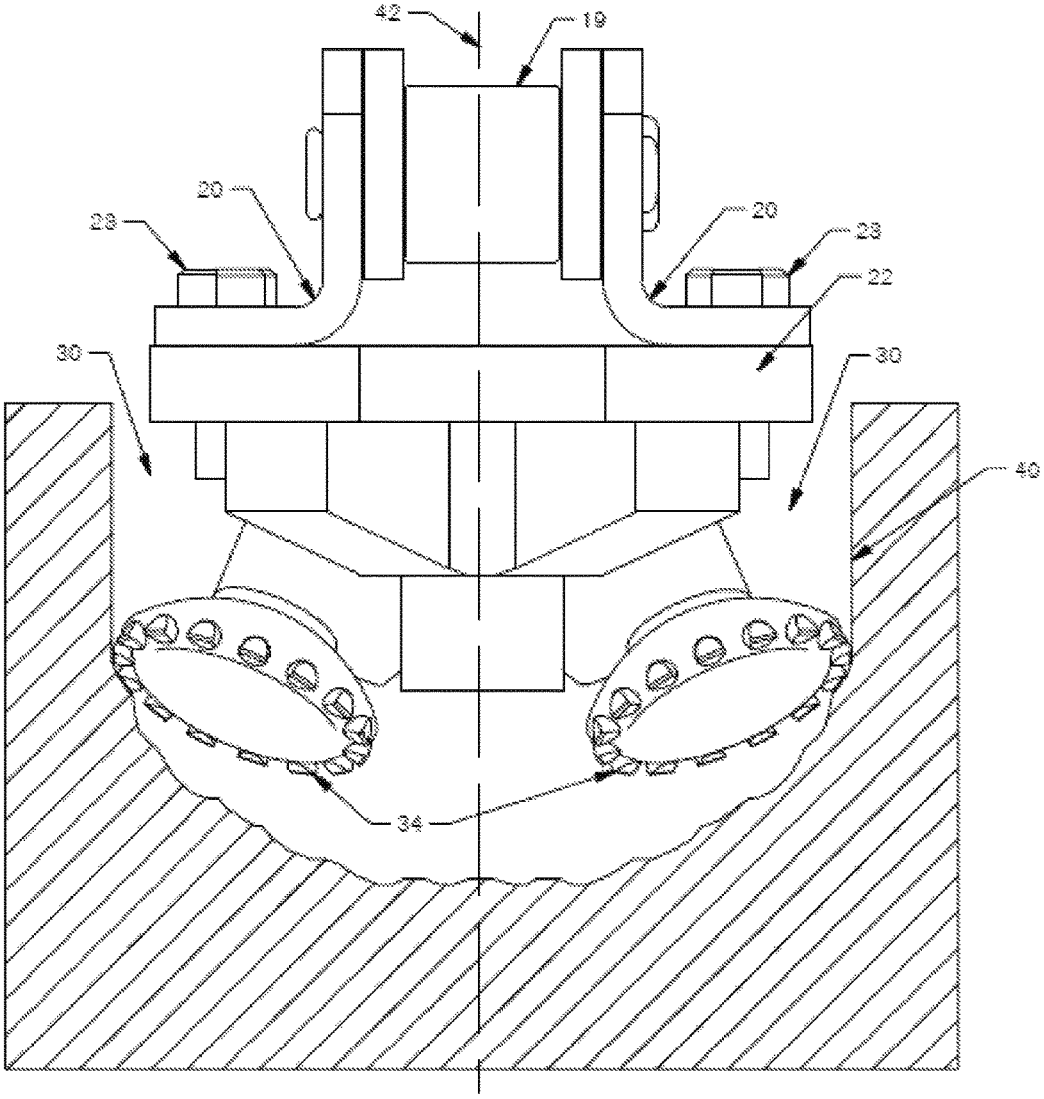

FIGS. 3A-3C depict bottom cutters 32 that cut the bottom of the trench. Thus, these cutters 30 act as bottom cutters 32 and operate on the bottom of the trench as explained in more detail below. In this embodiment, the bottom cutters 32 shown in the first station of the series in FIG. 3A have the greatest depth into the trench and the smallest lateral offset distance from centerline 42. Thus, these bottom cutters 32 act on the surface being cut at a comparably deeper center portion of the trench profile 40. The next station shown in FIG. 3B has bottom cutters 32 with a slightly greater lateral offset distance from centerline 42, and a slightly shallower depth in the trench. The bottom cutters 32 shown in FIG. 3C have a slightly shallower depth than the cutters of FIG. 3B and with a greater lateral offset distance from the centerline 42. These bottom cutters FIG. 3A through FIG. 3C operate on the material being cut to form the deepest center part of the trench profile 40. In situations where a wider final trench is desired bottom cutters in addition to those in FIGS. 3A, 3B, and 3C might be employed to create such a wider trench. For example, a wider trench could include additional stations with bottom cutters 32.

Following the bottom cutters, the station shown in FIG. 3D includes side cutters 34 that operate on the sidewalls of the trench profile 40. As illustrated in FIGS. 3D-1 and 3D-2, the side cutters 34 (FIG. 3D-2) cooperate with bottom support cutters 36 (FIG. 3D-1) as explained in more detail below. Similar to the bottom cutters 32 of FIGS. 3A through 3C, each pair of side cutters 34 and bottom support cutters 36 of FIGS. 3D-1 and 3D-2 are paired and have different depth and lateral offset distances from centerline 42, so as to act on different trench sections along the boundary of the trench profile 40.

Following the bottom cutters, in the station shown in FIG. 3E, the side cutters 34 cooperate as illustrated in FIG. 3E-1 with the bottom transition support cutters 38 as explained in more detail below. Similar to the bottom cutters 32 of FIGS. 3A-3C, each pair of side cutters 34 and bottom transition support cutters 38 of FIGS. 3E-1 and 3E-2 are paired and have different depth and lateral offset distances from centerline 42, so as to act on different trench sections along the boundary of the trench profile 40.

The pairs of cutters 30 are arranged in such a manner that within each pair, one of the cutters 30 acts on one side of the trench profile 40 with respect to centerline 42, while the other cutting element in the pair acts on the opposing side of the trench profile 40 with respect to centerline 42. For simplicity, the portions of the trench profile 40 on opposing sides of centerline 42 are described herein as the left side and the right side of the trench profile 40. However, it should be understood that the use of the terms left and right is unrelated to the orientation of any other portion of the machine on which the cutter assembly is mounted. In a preferred embodiment, the positions of the cutters 30 in the series of stations illustrated in FIG. 3A-3E are set such that each cutter in a pair operates respectively on either side of the centerline of the trench profile 40 and has a different depth and a different lateral offset distance (from the centerline 42). The changing position of the cutters 30 thereby forms the trench profile 40 that has a tapered shape.

The cutting action of each of the cutters 30 can be better understood with reference to FIGS. 4-7. As shown in FIG. 4A, each of these cutters 30 freewheel in the cutter mount 24, and are part of the cutter station that attaches to the cutter carrier chain 16. The cutters 30 each include a circumferential cutting surface 50 that advances as the cutters 30 are transported by the cutter carrier chain 16 while rotating in a freewheeling manner as they contact the surface P1 being cut (FIG. 7).

Figure 4A:
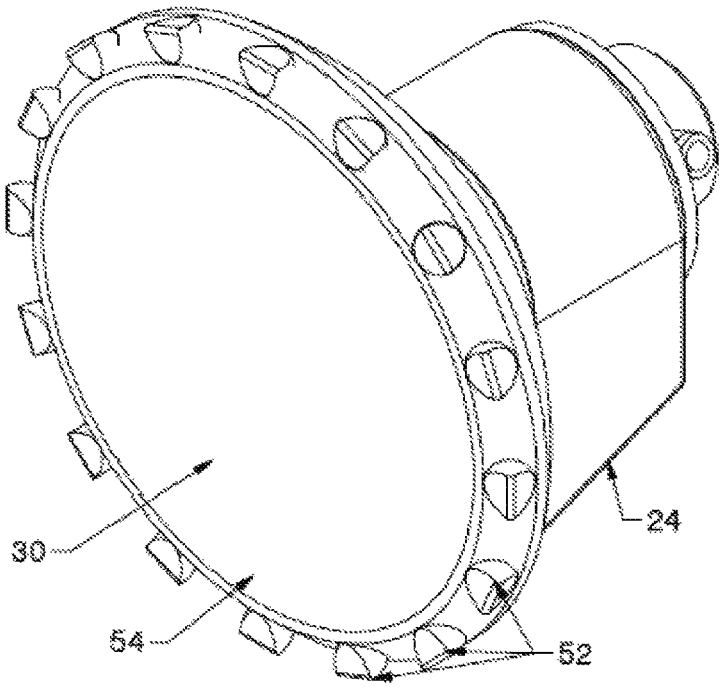
FIG. 4A shows a perspective view of a cutter mount assembly with a freewheeling cutter.
Figure 4B:
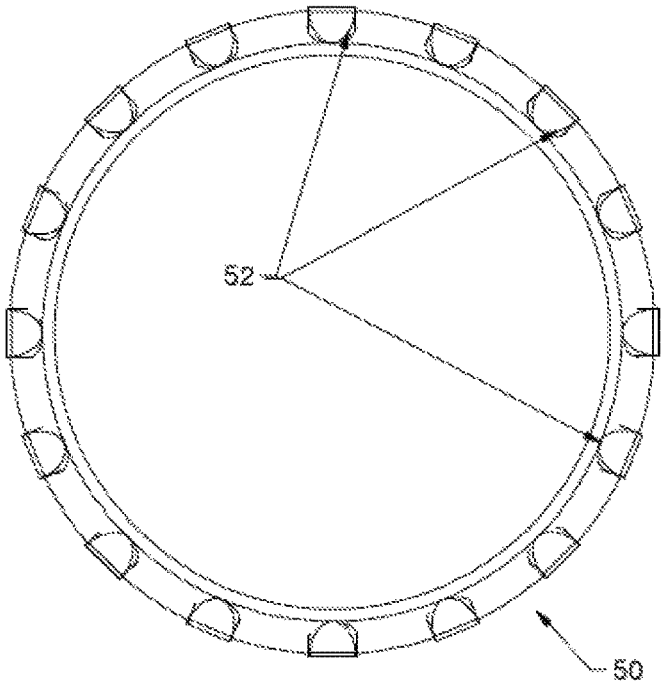
FIG. 4B shows a front view of the cutter of FIG. 4A.

The circumferential cutting surface 50 can be continuous, or may be interrupted. For example, as shown in FIGS. 4A and 4B, for cutting extremely hard earthen materials, the circumferential cutting surface 50 can include individual cutting teeth 52 encased in the body 54 of the freewheeling cutter 30. Thus, the cutting surface is disposed around the body 54 of the cutter 30, which in the illustrated embodiment is formed as a wheel or disk with cutting teeth 52 included for cutting extremely hard earthen materials. Advantageously, the disk or wheel shaped body 54 of the cutters 30 can include a concave inner surface 56 with the inner concave side of body 54 removed. This has the effect of lengthening the cutting teeth 52, and further concentrates the cutting forces of the cutting teeth around the outer periphery of the cutters 30, particularly at the outer circumferential cutting surface 50. Further, the cutting surface may also be scalloped between encased cutting teeth 52 to further concentrate the cutting forces of the cutting teeth 52 around the outer periphery of the cutters 30. The relieved concave central portion of the cutter body 54 also further facilitates removal of the loose material produced by the cutting action of the cutters 30. Alternatively, the body 54 of the cutters 30 can be flat. For example, the cutters can be formed as simple wheels with or without cutting teeth 52 extending outward from an outer face of the wheel. Thus, the circumferential cutting surface 50 could be formed simply by the outer circumference of the cutter body 54. Further still, the circumferential cutting surface could include features other than cutting teeth 52, such as ridges or buttons. For example, one or more of the cutting teeth 52 of the cutter shown in FIGS. 4A and 4B could be replaced by rounded buttons in place of pointed teeth.

Figure 5:
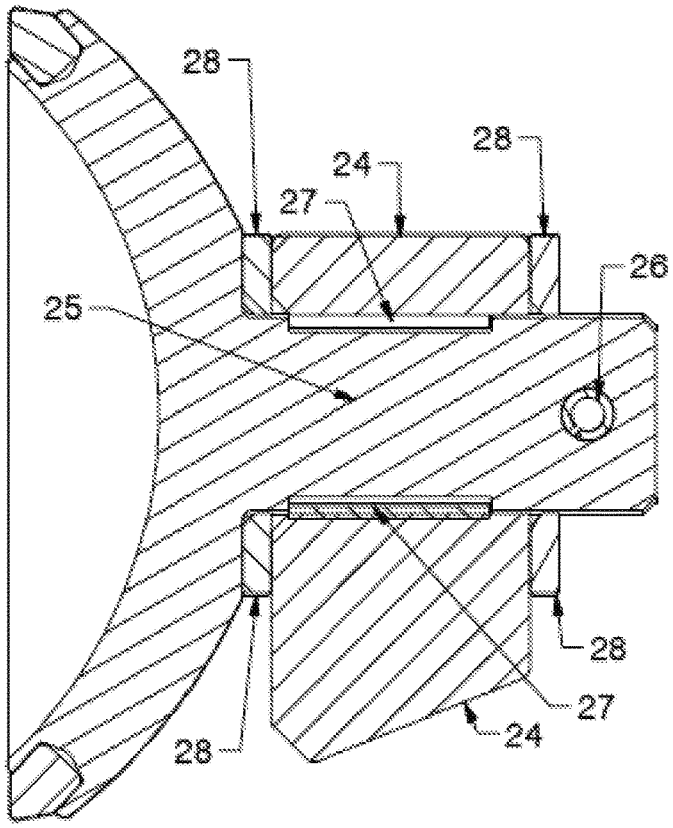
FIG. 5 depicts a cross section or the cutter mount assembly of the cutter shown in FIG. 4A.

FIG. 5 illustrates an embodiment of the attachment of the cutters 30 to the cutter mount 24. In the illustrated embodiment, each cutter 30 has a shaft 25 projecting from one side thereof to journal the cutter shaft 25 in a freewheeling manner in the cutter mount 24. Alternatively, the shaft could be fixed in place and the cutters 30 could include a bore that receives the fixed shaft in a freewheeling connection. The term freewheeling, as used herein, describes the connection of the cutters 30 to a corresponding mount on the cutter station, which in this case is attached to the carrier plate 22 and connected to the cutter carrier chain 16. Specifically, this cutter connection is referred to as freewheeling in that the components or machinery of the cutting station do not directly impart or inhibit any rotational motion of the cutters 30 with respect to the cutter mount 24. Instead, in the freewheeling connection of the cutters 30, any rotation of the cutters 30 only occurs as a result of a relative movement between the transport device (carrier plate 22) and an external earthen material that is in contact with the cutter 30, such as surface P1 illustrated in FIG. 7 being penetrated and cut.

In one embodiment, the freewheeling connection of the cutter 30 with the cutter mount 24 is provided by a shaft 25 that is integral with the cutter 30 as a single monolithic piece held in the cutter mount 24. Likewise, the cutter mount 24 is securely attached to the carrier plate 22 in order to maintain a strong connection of the cutters 30 to the cutter carrier chain 16. To hold the cutters 30 in place, the shaft 25 can extend all the way through a hole formed in the cutter mount 24. As shown in FIG. 5, the shaft 25 is held captive by a pin 26 that passes through an opening in the shaft on the side of the cutter mount 24 opposite the cutter body 54. The end of the body-side of the hole in the cutter mount 24 can be slightly flared to accommodate the radius in the corner where the rear surface of the body 54 of the cutter 30 merges with the shaft 25. The bearing surface for the shaft 25 of the cutter 30 can be formed by the cylindrical wall of the hole in the cutter mount 24. Thus, the entire load imposed on the cutters 30 during a cutting operation is borne by the cutter mount 24, and eventually by the carrier plate 22, the mounting plates 20 and the chain. One particular alloy steel that could be used to produce the cutter mounts 24 would be steel with about 11 to 15 percent manganese and 0.7 to 1.4 percent carbon. Such a steel alloy is sometimes referred to as Hadfield manganese steel.

As an alternative to direct engagement of the shaft 25 with the hole in the cutter mount 24, a wear member, in the form of a sleeve 27 or sacrificial ring, can surround the shaft 25 to provide a wear surface between the shaft 25 and the cutter mount 24. In the shown embodiment, the sleeve 27 sits within a wide groove in the shaft 25. A suitable spring steel is an example of an acceptable material for the sleeve 27. Further, a wear member can also be placed between the rear surface of the body 54 of the cutter 30 and the cutter mount 24 as well as between the cutter mount 24 and the pin 26. For example, FIG. 5 shows these wear members in the form of washers 28 (e.g., typically hardened steel) disposed between the cutter, the cutter mount 24 and the pin 26. Advantageously, the use of wear members, sleeve 27 and washers 28 reduces, wear on the cutters and cutter mounts, and provides an easily and inexpensively replaceable part when the sacrificial wear members are worn out.

Figure 6B:
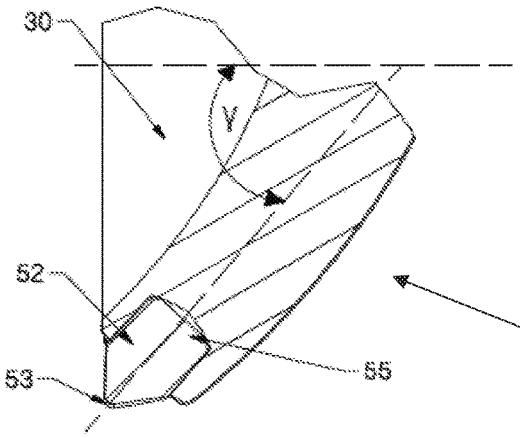
FIG. 6B is an enlarged view of a portion of the side view of the cutting tooth of the cutter shown in FIG. 6A.
Figure 6A:
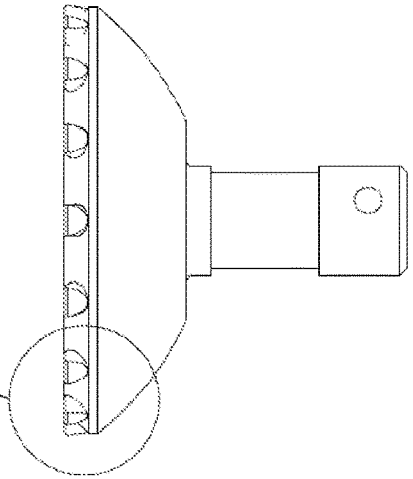
FIG. 6A is a side view of the cutter shown in FIG. 4A.

As discussed, in certain applications, the circumferential cutting structure 50 of the cutters may be continuous, for example in a circular shape. However, in many applications where a more aggressive cutting action is desired, it may be preferable for the cutting structure to include cutting teeth 52. For example, the cutter 30 shown in FIGS. 6A and 6B, depicts a side view of the cutting teeth 52 that forms the cutting surface 50 of the illustrated cutters 30. The depicted embodiment of the cutters 30 includes a number of outer teeth, which may range from as few as 3 to as many as 21 or more. The material being cut and penetrated determines the number of cutting teeth 52 required, where softer material may require fewer cutting teeth while harder earthen materials may require more cutting teeth 52. The number of cutting teeth will also be predicated on the overall circumference of the cutters. It is also possible for the cutter stations to include cutters with various numbers of cutting teeth 52. Advantageously, these cutting teeth 52 form an interrupted cutting edge of each cutter 30, thereby concentrating the cutting forces in the localized regions engaged by the cutting teeth 52 at any given instant. This enhances the cutting action of the cutters 30, permitting them to penetrate much harder materials than a round cutter 30 would without any cutting teeth. Moreover, the spaces between the cutting teeth facilitate release of the loose material fractured by the cutters, so that the loose material can be collected and transported upwardly out of the trench.

In the depicted cutter shown in FIGS. 6A and 6B, the cutting teeth 52 are fashioned as inserts that are held in receiving cavities formed in the body 54 of the cutters 30. Preferably, a sharp cutter point 53 of each cutting tooth 52 points outward and is exposed, but a base 55 of the cutting tooth 52 may be encased in the body 53 of the respective cutter 54. Accordingly, the encased base 55 can be surrounded by the cutter body 54 so as to be supported by the cutter body 54 on all sides. Constructing the cutting teeth 52 as inserts allows the cutting teeth 52 to be made of a different material than the body of the cutters 30. For example, the cutting teeth 52 can be made of a highly wear resistant material, such as a carbide or diamond tipped material. An example of a suitable carbide material is YK20 (e.g., 90.5% course grade tungsten carbide and 9.5% cobalt). In certain applications, the use of cutting teeth 52 made of such a material can extend the life of the cutters 30 considerably. Alternatively, the cutting teeth can be formed of the same material as the body 54 of the cutters 30. Indeed, the cutting teeth 52 can be integrally formed with the rest of the cutters in certain embodiments.

Preferably, the circumferential cutting surface 50 includes cutter points 53 that point outward from the cutter axis of rotation 39, and where the cutter point 53 is disposed at an angle to the axis of rotation of the cutter. Preferably, the cutter points 53 are disposed at an angle between 15° and 75° relative to the cutter axis of rotation 39. For example, the cutting surface may include discrete cutting teeth with individual cutting points or a continuous cutting edge with an indistinct number of cutter points that point outward from the axis of rotation 39 and at an angle thereto. In FIGS. 6A and 6B the cutter points are illustrated as part of the cutting teeth 52, such that the illustrated teeth have chisel tips that are angled with respect to the axis of rotation of the cutter 30 between 22° and 60°. Having an angle of the cutter point that is neither perpendicular to the shaft 25 of the cutter nor parallel to the shaft 25 of the cutter promotes the cutting action of the cutters 30 and precludes the cutting teeth 52 from operating in a crushing mode. Instead, the cutting teeth 52 engage and penetrate the earthen material being removed as the cutting stations with the combined side or disk angle and tilt angle freewheel across the earthen material being cut in a rolling wedge earthen material removal action. In the illustrated embodiment, the cutter point 53 of each cutting tooth 52 is formed as a cutting edge. Alternatively, the cutter point 53 of the cutting teeth 52 could be formed by to point such as a bullet point, as a conical point or as a double conical point. And alternately the cutting teeth 52 could be a combination of chisel tips, bullet tips or double conical cutter points 53 intermixed on a cutter 30. With respect to the angle of the tip of the cutting tooth, it should be understood that the orientation of the cutting tooth 52 cutter point 53 is defined with regard to a line passing through the tip that bisects the cutter point 53, as shown by the dotted line FIG. 6B. The cutter point 53 is then angled upon insertion into the body 54 of the cutter 30, so as to form the angle $\gamma$ with the axis of rotation of the cutter. This angle of the cutter point 53 allows the cutting teeth 52 to cut into earthen material as the cutter 30 rolls at an angle across the surface being cut, which will be described in more detail below following the description of FIGS. 7A-7D.

In accordance with embodiments of the present invention, each of the cutters 30 shown in FIGS. 2-6 is canted with respect to two mutually perpendicular planes.

Figure 7A:
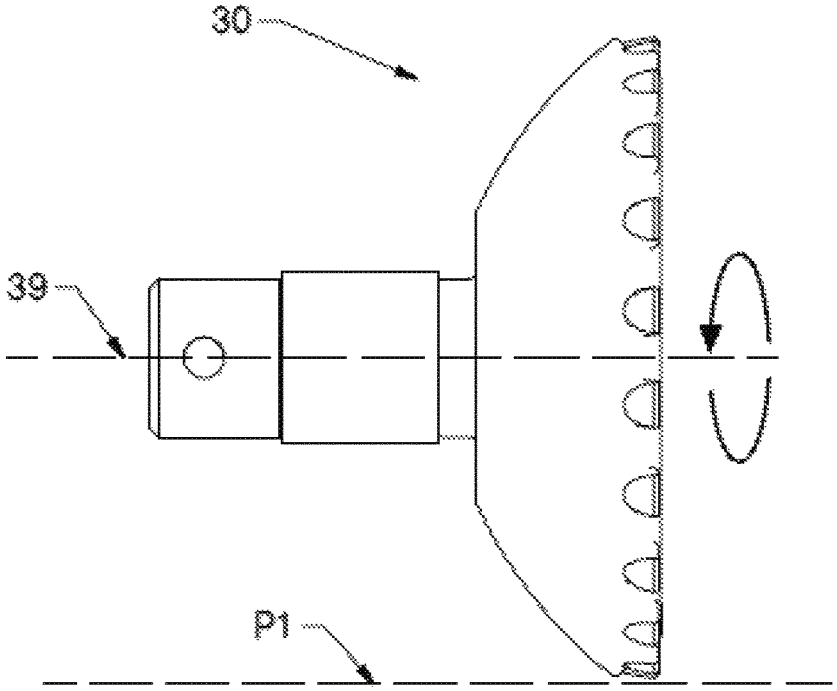
FIG. 7A is a schematic diagram illustrating a side view of a cutter of FIGS. 4-6 with the freewheeling rotation of this cutter illustrated by the rotational arrow.

To demonstrate the directions in which the cutters 30 of the described cutting assembly are canted, FIGS. 7A-D show cutters 30 canted in various directions. To better understand the angles at which the cutters are canted, it should be understood that each cutter depicted in FIGS. 7A-D is positioned above a surface represented by P1 and is mounted to a cutter mount 24 that is imparting a line of action to the cutter that is depicted as coming forward out of the page. In this case, the cutter 30 shown in FIG. 7A is not canted, so that the axis 39 of rotation of the cutter 30 is parallel to the surface P1 and is perpendicular to the line of action. The rotation of the cutter 30 is depicted by the rotational arrow to the right of the cutter 30 in FIG. 7A. This cutter 30 shown in FIG. 7A is well aligned for ideal rolling of the circumferential cutting surface 50 along the plane represented by P1. However, this ideal rolling is not advantageous for penetrating and cutting the plane P1.

Figure 7B:
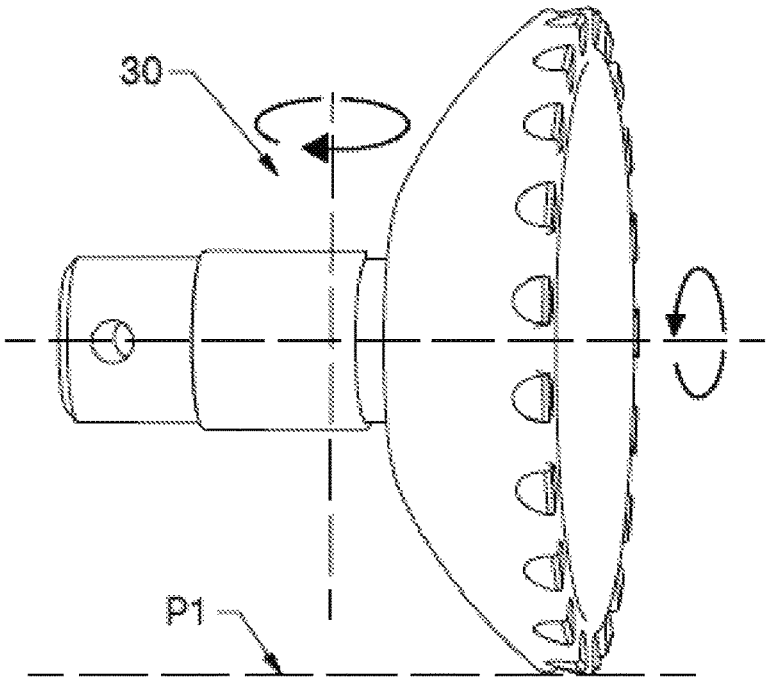
FIG. 7B is a schematic diagram illustrating the cutter of FIG. 7A rotated about a vertical centerline as shown by a rotational arrow above the cutter.

Thus, in order to improve the cutting action of the cutters 30 they are canted such that the axis or rotation is rotated clockwise from above in a plane parallel to the plane P1 being cut, as shown in FIG. 7B. As a result, the front of the cutter 30 is turned slightly toward the line of action being imparted by the cutter carrier chain 16. This angle is defined herein as the disk angle or side angle α, shown in FIG. 11. Further, the slight rotation of the cutter 30 resulting from this angle is depicted by the rotational arrow above the cutter in FIG. 7B. The side angle of the cutter 30 improves the cutting performance of the cutters because, as the cutters 30 are moved straight forward, this side angle imparts a penetrating action on the plane P1 with the rotating axis of the cutter being at an angle to the line of action moving the cutter forward. This disk or side angle relative to the direction of travel provides a greater interaction between the cutter and the plane P1 being cut. The side angle α also generates a larger cutting area for the cutter 30. If the cutters 30 are relatively thin, the side angle cant described above may be sufficient to achieve a desired cutting action.

Figure 7C:
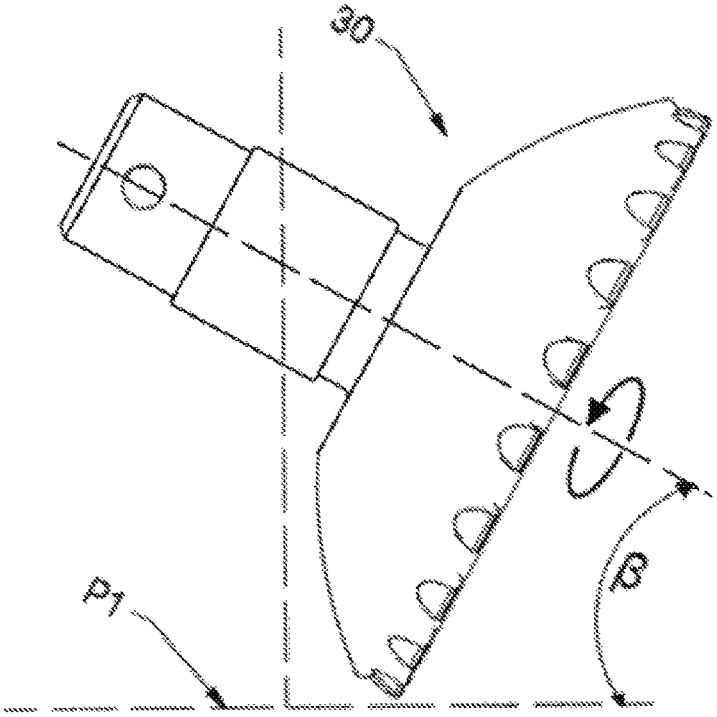
FIG. 7C is a schematic diagram illustrating a penetrating canted tilt angle of the cutter of FIG. 7A with the canted tilt angle of the cutter illustrated by angle Beta.
Figure 7D:
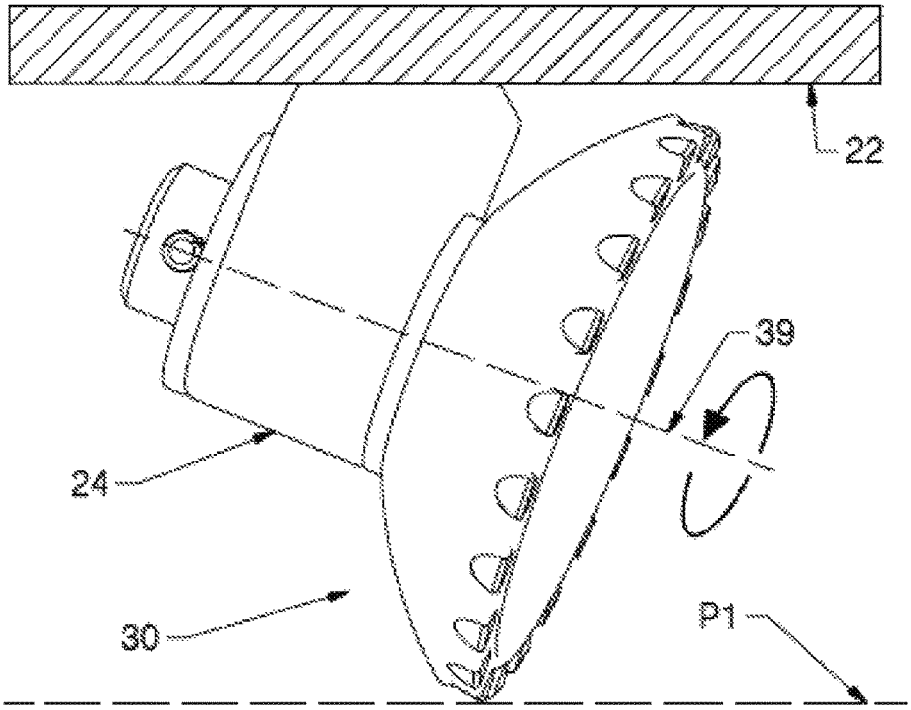
FIG. 7D a is a schematic diagram illustrating a cutter mount assembly with the combined penetrating side angle of FIG. 7B and the penetrating tilt angle of FIG. 7C.

However, for thicker cutters 30, a second cant or tilt angle may provide even better cutting penetration. For example, the cutters 30 may be tilted or canted as shown in FIG. 7C, wherein the axis of rotation is angled toward the surface P1 being cut, such that the face of the cutter is turned slightly toward the surface P1. This angle is defined herein as the tilt angle β. The tilt angle β is beneficial for providing teeth of the cutter with a more aggressive penetrating cutting action. This can be clearly seen in FIG. 7C, where the cutting teeth 52 adjacent to the surface P1 are pointed into the surface P1 compared to the cutting teeth 52 in FIG. 7B. Additionally, the tilt angle β is advantageous for reducing any cutter drag on the rear portion of the cutters 30, opposite the circumferential cutting body 54.

The two angles α and β, by which the cutters 30 are canted, may be varied somewhat for different applications, and the optimum angles will depend in part on the particular earthen material being cut and the cutter 30 materials. It is generally preferred that each angle α and β can be within the range of about 7.5° to 30° more or less. It has been found that angles within this range provide efficient cutter 30 cutting and penetration action without imposing an excessive load on the cutters 30. In the illustrative cutter assembly (FIG. 2), both the side angle α and the tilt angle β of each of the cutters 30 is fixed by the corresponding cutter mount 24. The base of the cutter mount 24 may be angled from 0° to 45° facilitating the cutter mount 24 side angle α and tilt angle β positioning.

While the cutters 30 of the cutting stations are canted in two directions with respect to the surface being cut, it should be understood that typically these angles are less than 30°, such that the axis of rotation of the cutters 30 is substantially aligned with ideal rolling. The term substantially aligned as used herein is defined as a cutter axis of rotation that is no more than 30° from an ideal rolling axis, where the ideal rolling axis is perpendicular to the line of action and parallel to the surface being contacted by the cutters.

Referring now to FIGS. 1-7 for a more detailed description of the cutting action of the canted cutters 30, it will be assumed for the sake of discussion that the illustrative trencher is being used to cut a trench through concrete or other earthen materials. Each time one of the cutting teeth 52 comes into engagement with the concrete, the advancing movement of the cutter carrier chain 16 causes the cutting teeth 52 to be driven across the concrete face in both a forward and sideways motion. As such, the side-to-side pairing of the cutters 30 generally neutralizes the sideways forces created by the cutters' 30 engaged movement forward. Due to the cant of the cutters, pressure is exerted on the earthen material by the cutting teeth 52 and can be concentrated at the engaged cutter tooth 52, thereby facilitating the initial penetration of the cutter tooth 52 into the concrete or other earthen material. Then, as the freewheeling cutter 30 rotates, as facilitated by the advancing movement of the cutter carrier chain 16, the cutting tooth 52 that has penetrated the concrete rotates and moves laterally because of the cutter 30 cant and lifts vertically as it rotates at the same time. This movement creates a tensile lifting and pulling action (rather than a compressive load) on the concrete or earthen material. As the cutter 30 freewheels, the cutting teeth 52 which have penetrated the material pull up on the material creating a rolling wedging action as the cutter disk angle or side angle causes the cutting teeth 52 of cutter 30 to move sideways as the cutter 30 rotates forward. This wedging action is enhanced by the tapered or wedge-shaped cross-sectional configuration of the cutting tooth 52 (see FIG. 6B). Concrete and most other earthen materials are much weaker in tension than in compression, and thus are more easily fractured by the tensile upward pulling load applied as this rolling wedge rotates forward. There is also less wear and tear on the cutters because the resistance offered by the concrete or other earthen materials to tensile loads is far less than it is to compressive loads.

The rolling lifting action of the cutters 30 breaks the material in fragments, rather than abrading away the concrete through fractured compression loading that would create dust or small particles. This type of rolling wedging cutting action of the present invention is highly efficient and, therefore, can be carried out at relatively fast cutting rates while at the same time extending the life of the cutters 30.

Figure 8:
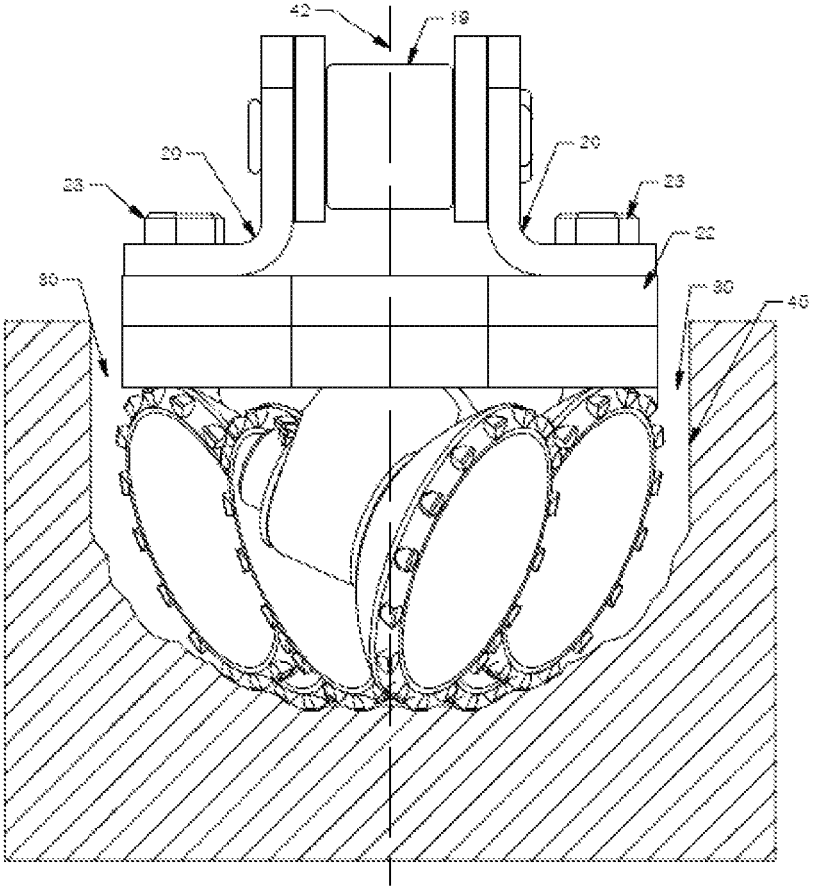
FIG. 8 is a composite view of the bottom trench cutters shown in FIGS. 3A-3C.
Figure 9:
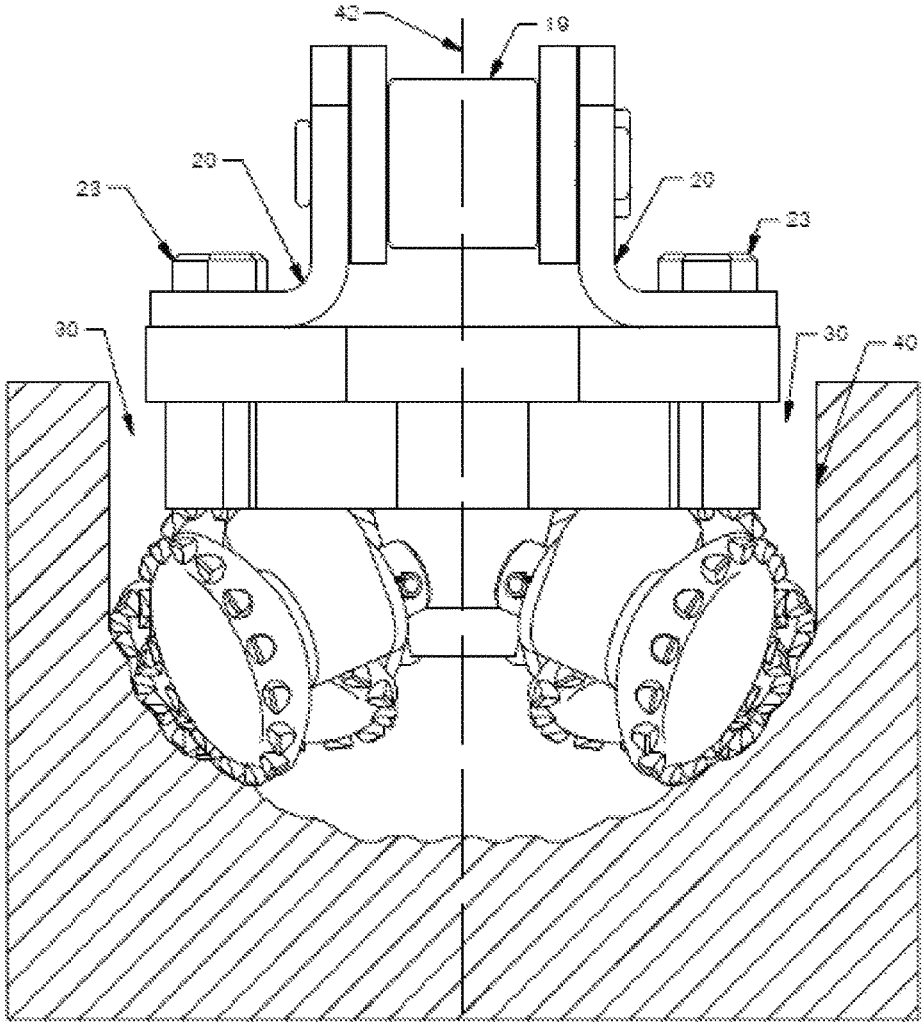
FIG. 9 is a composite view of the side trench cutters shown in FIGS. 3D and 3E.

FIG. 8 most clearly shows the position of the bottom cutters 32 that form the cutting stations depicted in FIGS. 3A-3C. As depicted, these bottom cutters collectively form the contour of the bottom of the trench profile 40. To maintain a rolling wedging action, the axis of rotation of each of the bottom cutters 32 is substantially aligned with the carrier plate 22, where the term substantially aligned is defined above. In contrast, FIG. 3D-2 & FIG. 3E-2 illustrate how the side cutters 34 form the outermost lateral sides of the trench profile 40. To form this portion of the trench profile 40, the side cutters 34 engage with the sides of the trench. For effective cutting action, the axis of rotation of each of the side cutters 34 is substantially set and aligned with the trench bottom cutters 32.

To help maintain the side cutters 34 at a proper position within the trench, as illustrated in FIG. 3D & FIG. 3E, the cutter stations 31 include side cutters 34 and may also include a bottom support cutter 36 or bottom transition support cutters 38. These bottom support cutters 36 and bottom transition support cutters 38 set the height of the side cutters above the bottom of the trench. In certain instances, removal of the side cutter support bottom/bottom transition cutters can result in the side cutters 34 being too close to the trench bottom profile, whereby the trench side cutters 34 may be damaged as too large a portion of the face of the cutter engages with the material being cut, and portions of the circumferential cutting structure drag along the trench bottom surface, rather than cutting the trench sidewalls. In the depicted embodiment, the side cutter support cutters are bottom support cutters 36 and bottom transition support cutters 38 that aid in the cutting of the outside bottom trench corners. Preferably, the support cutters contact the bottom of the trench so as to prevent excessive movement of the side cutters 34 into the trench profile 40. Here, the bottom support cutters 36 and bottom transition support cutters 38 assist in the cutting of the trench by engaging the bottom side corners of the trench in a rolling wedging action. Alternatively, it is also possible that a support element be free of any cutting teeth 52 and roll along the bottom of the trench without substantial cutting action. In the depicted embodiment, the support elements are shown as bottom support cutters 36 and bottom transition support cutters 38. While the bottom support cutters 36 are tilted at the same angle as bottom cutters 32, the bottom transition support cutters 38 are tilted at a somewhat steeper angle than the bottom cutters 32. This angle allows the bottom transition support cutters 38 to engage the trench profile 40 nearer the transition between the bottom and side of the trench.

Figure 12:
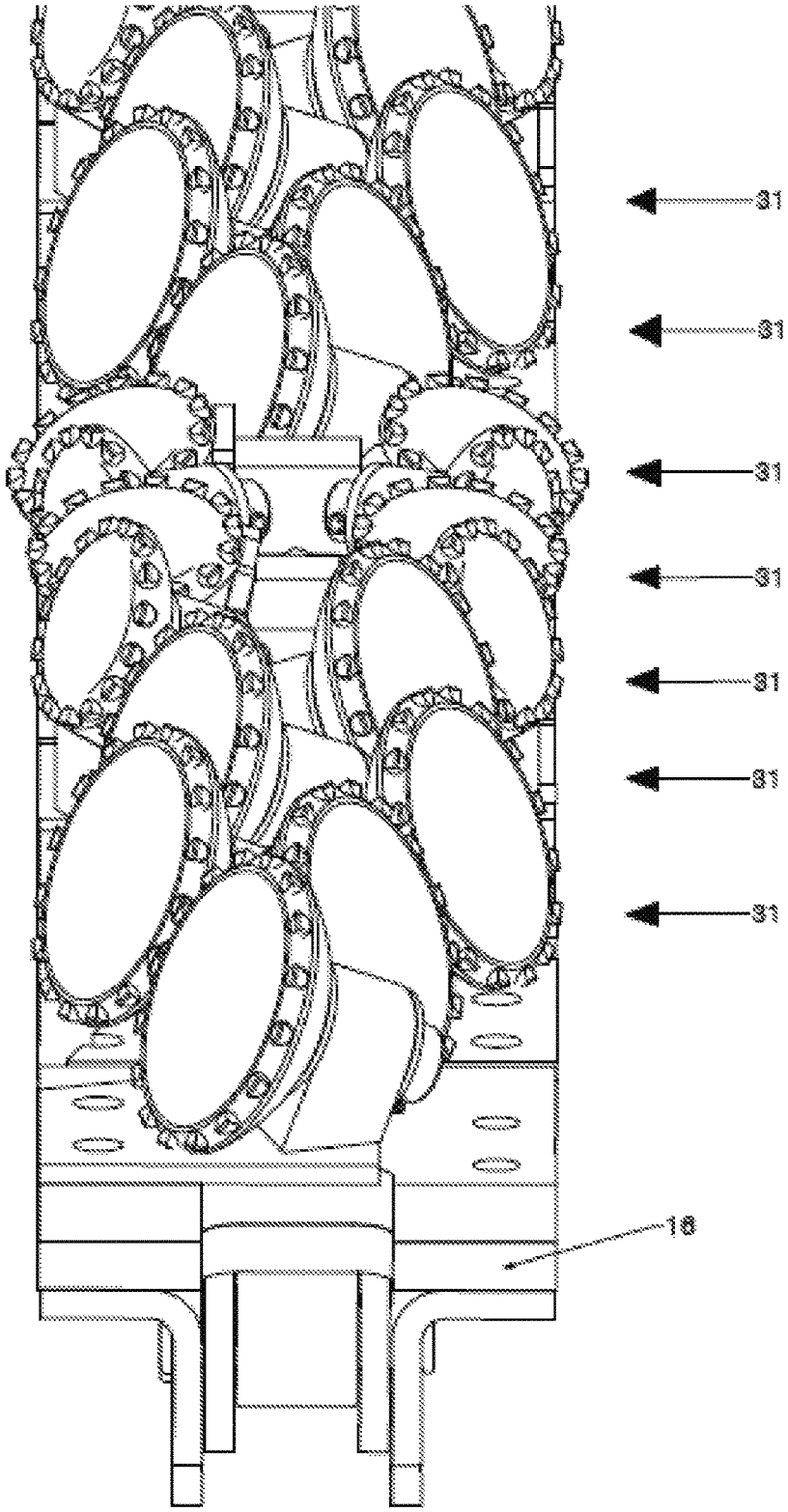
FIG. 12 is a top perspective view of the trench cutter stations shown in FIGS. 10 and 11.

FIGS. 10 and 11 show the entire series of cutter stations 31. As shown, the three cutter stations 31 with bottom cutters 32 are arranged at the front end of the series and the two cutter stations 31 that include side cutters 34, bottom support cutters 36, and bottom support transition cutters 38 are arranged at the rear end of the series. As illustrated in these FIGS. 10 and 11 the three bottom cutter stations 31 move progressively further toward the outside of the trench and slightly shallower in the trench profile 40, whereas the side cutter stations 31 then expand the width of the trench by cutting the sidewalls of the trench profile 40. FIG. 12 illustrates the transition from one series of cutter stations to the next series as the cutter stations 31 are repeated around the cutter carrier chain 16.

Just as the configuration and spacing of the cutters 30 on the driven cutter carrier chain 16 can be variable, the diameter of the cutters 30 can also be varied. For example, the cutters 30 can range in size from several inches in diameter to less than an inch in diameter. The selection of diameter can depend on the particular driven cutter carrier chain 16 and the particular application for which the cutters 30 are being applied. These variations are possible regardless of whether the transport device is a cutter carrier chain 16, as shown in the drawings, or if the cutters 30 are mounted on a rotating shaft or tube, on a reciprocating blade or arm, or on the face of a rotating cylinder.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one or A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A cutter assembly for earthen materials comprising:

a transport device carrying a plurality of cutting stations so as to drive the cutting stations in a direction of movement, each cutting station including at least one freewheeling cutter that is freely rotatable about a respective axis of rotation, wherein:

the respective cutter axis of rotation of at least a portion of the freewheeling cutters is canted by a tilt angle toward a plane of the surface being cut and is also canted by a side angle toward the direction of movement;

each freewheeling cutter includes: (a) a cutting surface comprising cutter points that point outward from the respective cutter axis of rotation, the cutter points being disposed at an angle relative to the cutter axis of rotation and arranged around a circumference of the cutting surface, and (b) a cutter body encasing a base of each cutter point so each base of each cutter point is entirely surrounded by the cutter body.

2. The cutter assembly recited in claim 1, wherein at least a portion of the freewheeling cutters are arranged in pairs, with a first cutter in each pair operating on a first side of a profile being cut by the cutter assembly and the other cutter in the respective pair operating on an opposing side of the profile being cut.

3. The cutter assembly recited in claim 2, wherein a majority of the freewheeling cutters are arranged in pairs.

4. The cutter assembly recited in claim 1, wherein the cutter points are formed by individual cutting teeth.

5. A cutter assembly for earthen materials comprising:

a transport device carrying a plurality of cutting stations so as to drive the cutting stations in a direction of movement, each cutting station including at least one freewheeling cutter that is freely rotatable about a respective axis of rotation, wherein:

the respective cutter axis of rotation of at least a portion of the freewheeling cutters is canted by a tilt angle toward a plane of the surface being cut and is also canted by a side angle toward the direction of movement;

each freewheeling cutter includes a cutting surface comprising individual teeth that point outward from the respective cutter axis of rotation, wherein the individual teeth are arranged around a circumference of the cutting surface and each individual tooth has an exposed end that points outward from the respective cutter axis of rotation and forms a cutter point and a base of the cutter point that is encased in a body of the cutter so as to be entirely surrounded by the cutter body, the cutter points being disposed at an angle between 15° and 75° relative to the cutter axis of rotation.

6. The cutter assembly recited in claim 5, wherein at least one of the cutting stations includes side cutters that engage lateral sides of the cut profile and at least one support that maintains a predetermined depth position of the side cutters in the cut profile.

7. The cutter assembly recited in claim 6 wherein the support is a bottom cutter that engages a bottom of the cut profile.

8. The cutter assembly recited in claim 5, wherein at least a portion of the freewheeling cutters are arranged in pairs, with a first cutter in each pair operating on a first side of a profile being cut by the cutter assembly and the other cutter in the respective pair operating on an opposing side of the profile being cut.

9. The cutter assembly recited in claim 8, wherein a majority of the freewheeling cutters are arranged in pairs.

10. The cutter assembly recited in claim 5, wherein the cutting teeth include chisel tips that form the respective cutter points.

11. The cutter assembly recited in claim 10, wherein the angle of the cutter points to the axis of rotation of the cutter is between 22° and 60°.

12. The cutter assembly recited in claim 5, wherein a front surface of each freewheeling cutter is concave, wherein the respective cutter axis of rotation intersects the front surface.

13. The cutter assembly recited in claim 5, wherein each cutter includes a rotating shaft that is held in a respective mount, and wherein wear members are disposed between the cutter and the mount, the wear members including a sleeve surrounding the rotating shaft and at least one washer between the cutter and the mount.

14. The cutter assembly recited in claim 5, wherein the cutters are held in respective mounts, and the cutters are retained in the mounts using retaining pins.

15. A cutter assembly for earthen materials comprising:

a transport device carrying a series of cutting stations so as to move the cutting stations in a direction of movement such that the cutting stations cut through a material and form a cut profile, each cutting station including at least one freewheeling cutter that is freely rotatable about a respective axis of rotation, wherein:

the respective cutter axis of rotation of each of at least a portion of the freewheeling cutters is disposed at an angle relative to the direction of movement imparted by the transport device and is disposed at an angle relative to a surface being cut; and the freewheeling cutters in each cutting station in the series have a different lateral position and a different depth so as to form a cut profile with a tapered shape including a deeper center and shallower sides, wherein each freewheeling cutter includes: (a) a cutting surface comprising cutter points that point outward from the respective cutter axis of rotation, the cutter points arranged around a circumference of the cutting surface, and (b) a cutter body encasing a base of each cutter point so each base of each cutter point is entirely surrounded by the cutter body.

16. The cutter assembly recited in claim 15, wherein the cutter points are disposed at an angle relative to the cutter axis of rotation and disposed at an angle relative to a direction perpendicular to the cutter axis of rotation.

17. The cutter assembly recited in claim 15, wherein the respective cutter axis of rotation of a majority of the freewheeling cutters is disposed at an angle to the direction of movement imparted by the transport device.

18. The cutter assembly recited in claim 17, wherein at least a portion of the freewheeling cutters are arranged in pairs, with a first cutter in each pair operating on a first side of the cut profile and the other cutter in the respective pair operating on an opposing side of the cut profile.

19. The cutter assembly recited in claim 18, wherein the opposing cutters in a cutter pair are disposed an equal and opposite distance from a horizontal center of the cutter assembly so as to balance cutting forces on opposing sides of the cut profile.

20. The cutter assembly recited in claim 15, wherein the cutter points are formed by individual cutting teeth.

21. The cutter assembly recited in claim 15, wherein a front surface of each freewheeling cutter is concave, wherein the respective cutter axis of rotation intersects the front surface.

22. The cutter assembly recited in claim 15, wherein a rotation of a respective freewheeling cutter about the respective axis of rotation causes the cutting teeth of the respective freewheeling cutter to move sideways with respect to a surface of the earthen material that is being cut.

* * * * *